US006938428B2

(12) United States Patent
Onishi et al.

(10) Patent No.: US 6,938,428 B2
(45) Date of Patent: Sep. 6, 2005

(54) ICE TRAY DRIVING DEVICE, AND AUTOMATIC ICE MAKING MACHINE USING THE SAME

(75) Inventors: Ichiro Onishi, Shiga (JP); Masatoshi Shokyu, Shiga (JP)

(73) Assignee: Matsushita Refrigeration Company, Shiga (JP)

( * ) Notice: Subject to any disclaimer, the term of this patent is extended or adjusted under 35 U.S.C. 154(b) by 13 days.

(21) Appl. No.: 10/808,533

(22) Filed: Mar. 25, 2004

(65) Prior Publication Data

US 2004/0177638 A1 Sep. 16, 2004

Related U.S. Application Data

(63) Continuation-in-part of application No. PCT/JP03/02575, filed on Mar. 5, 2003.

(30) Foreign Application Priority Data

Mar. 6, 2002 (JP) ..... 2002-059935

(51) Int. Cl.[7] ..... F25C 1/12
(52) U.S. Cl. ..... 62/135; 62/353
(58) Field of Search ..... 62/71–72, 135, 62/353

(56) References Cited

U.S. PATENT DOCUMENTS 4,852,359 A 8/1989 Mazzotti ..... 62/68
5,253,487 A * 10/1993 Oike ..... 62/353
5,400,605 A * 3/1995 Jeong ..... 62/72
5,617,728 A * 4/1997 Kim et al. ..... 62/71
5,970,725 A * 10/1999 Lee ..... 62/137
6,058,720 A * 5/2000 Ryu ..... 62/135

FOREIGN PATENT DOCUMENTS

| | | |
|---|---|---|
| JP | 2-230076 | 9/1990 |
| JP | 6-241627 | 9/1994 |
| JP | 8-110134 | 4/1996 |
| JP | 8-110135 | 4/1996 |
| JP | 2002-130877 | 5/2002 |
| JP | 2002-130883 | 5/2002 |

* cited by examiner

*Primary Examiner*—William E. Tapolcai
(74) *Attorney, Agent, or Firm*—Wenderoth, Lind & Ponack, L.L.P.

(57) ABSTRACT

An ice tray driving device has a mesh start section. The mesh start section includes a raised tooth formed by projecting at least one tooth of each of two output gears in the tooth width direction, a column section axially adjacent to the driving gear, a recessed tooth disposed in the column section and formed so as to mesh with the raised tooth, and a slide member for blocking the recessed tooth of the column section at a predetermined position. When the driving gear rotates one of the two output gears, the slide member keeps the blockage of the recessed tooth with respect to the raised tooth of the output gear that is not rotated to prevent the meshing. Thus, the meshing is started only by facing the raised tooth to the recessed tooth, the driving gear and the entire ice tray driving device can be downsized.

15 Claims, 19 Drawing Sheets

ICE TRAY DRIVING DEVICE, AND AUTOMATIC ICE MAKING MACHINE USING THE SAME

This application is a continuation-in-part application of international application PCT/JP03/02575, filed Mar. 5, 2003.

TECHNICAL FIELD

The present invention relates to an ice tray driving device of an automatic ice-making machine mounted to a domestic electric refrigerator, and relates to the automatic ice-making machine using the ice tray driving device.

BACKGROUND ART

Some automatic ice-making machines mounted to domestic electric refrigerators have a structure in which two ice trays are turned to remove ice. A driving device for driving two trays is disclosed in Japanese Patent Unexamined Publication No. H02-230076. A conventional automatic ice-making machine is hereinafter described with reference to drawings.

FIG. 20 is a schematic side view of the conventional automatic ice-making machine. FIG. 21 is a plan view of the inside of an ice tray driving device in FIG. 20.

Rotation of a motor (not shown) is transmitted to first gear 1 via a reduction gear (not shown). Gear 1 has gear region 1A formed in a range of substantially 90°, and the remaining toothless region 1B.

Second gear 2 and third gear 3 can mesh with gear region 1A of first gear 1 to rotate, but cannot mesh with toothless region 1B.

When gear 2 is meshing with gear region 1A and rotating, gear 3 is at rest and facing toothless region 1B. When gear 2 is at rest and facing toothless region 1B, gear 3 is meshing with gear region 1A and rotating.

Respective rotations of gear 2 and gear 3 are transmitted to trays 4 and 5. Therefore, tray 5 is horizontally at rest while tray 4 turns, and tray 4 is horizontally at rest while tray 5 turns.

In the conventional structure, however, for independently turning two trays, toothless region 1B must be set larger than gear region 1A in gear 1. These regions must be arranged so that gear 3 faces toothless region 1B when gear 2 faces gear region 1A and gear 3 faces gear region 1A when gear 2 faces toothless region 1B. Pitch circle diameter of gear 1 is thus larger than those of gear 2 and gear 3, and vertical size of the driving device is large. Therefore, when the driving device is installed in a refrigerator, the vertical occupied space thereof is required to be large.

When the ice tray driving device of the automatic ice-making machine has a large vertical size, height of an ice box for storing ice must be decreased to avoid interference between the ice tray driving device and the ice box and the ice storing amount is limited in the refrigerator.

The ice tray driving device for driving two trays in the automatic ice-making machine is therefore desired to have a small vertical size.

SUMMARY OF THE INVENTION

The present invention provides an ice tray driving device of an automatic ice-making machine that has a mesh start section for starting meshing of one of two output gears with a driving gear. The mesh start section includes a raised tooth, a column section, a recessed tooth, and a slide member. The raised tooth is formed by projecting at least one of the two output gears in the tooth width direction. The column section is axially adjacent to the driving gear. The recessed tooth is disposed in the column section and formed so as to mesh with the raised tooth. The slide member blocks the recessed tooth in the column section at a predetermined position. When the driving gear rotates, the slide member rotates together with the column section by a predetermined angle and then slide-contacts with the column section. When the driving gear rotates one of the two output gears, the slide member keeps the blockage of the recessed tooth with respect to the raised tooth of the output gear that is not rotated. The present invention provides an automatic ice-making machine using the ice tray driving device.

DETAILED DESCRIPTION OF PREFERRED EMBODIMENTS

Figure 1:
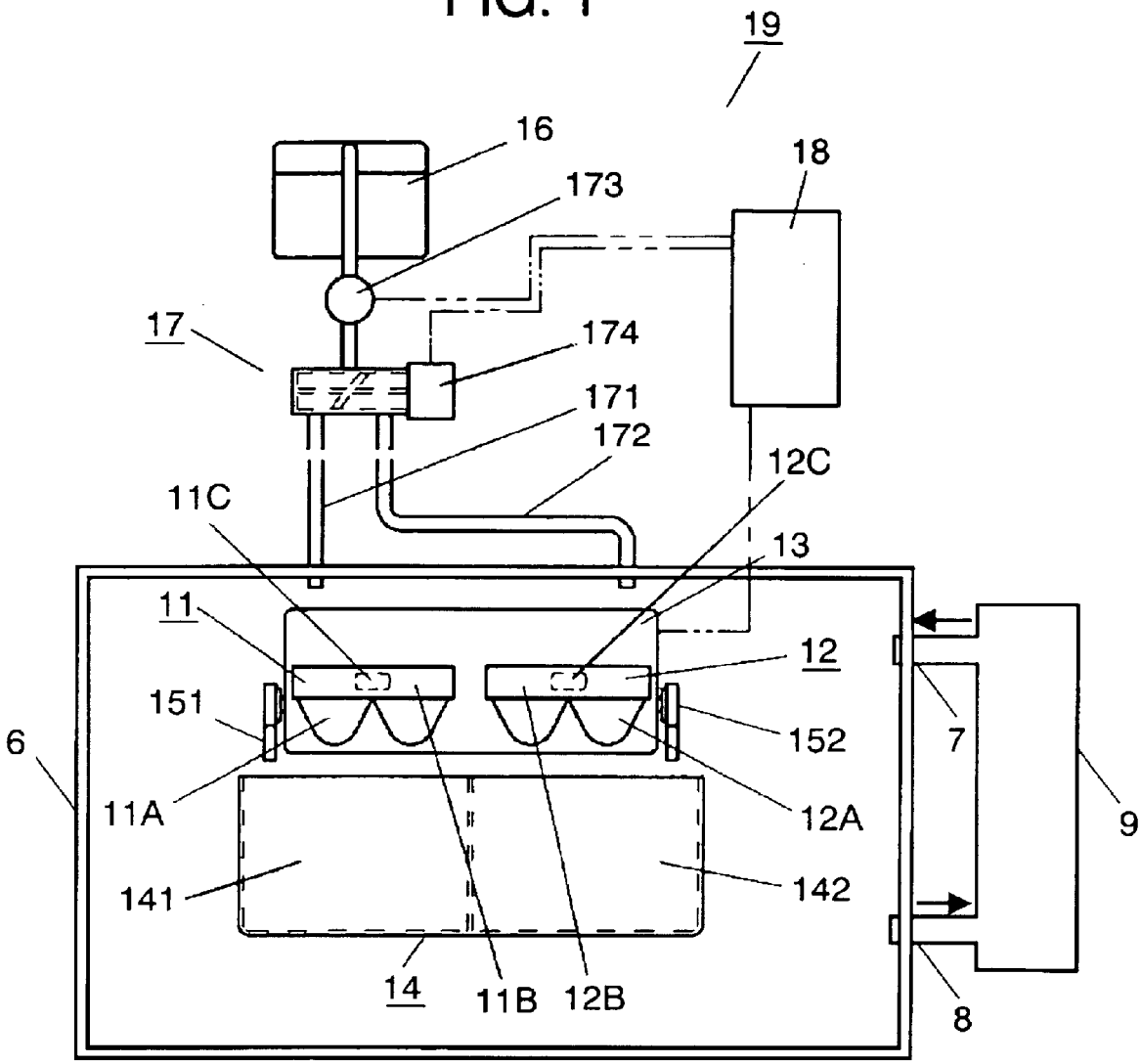
FIG. 1 is a front view of an automatic ice-making machine including an ice tray driving device in accordance with an exemplary embodiment of the present invention.
Figure 2:
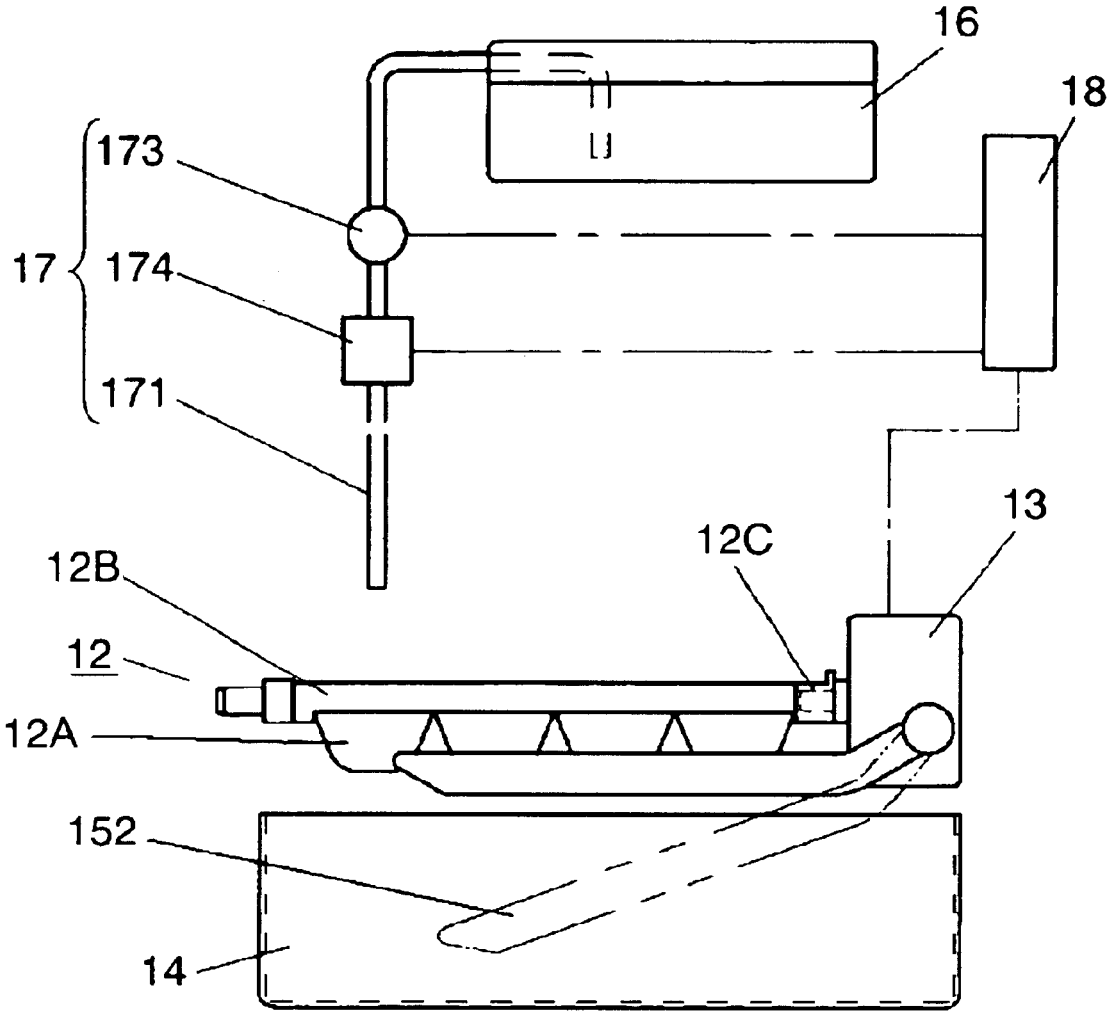
FIG. 2 is a side view of the circumference of the ice tray driving device in FIG. 1.

FIG. 1 is a front view of a circumference of an ice tray driving device of an automatic ice-making machine in accordance with an exemplary embodiment of the present invention. FIG. 2 is a side view of the circumference of the ice tray driving device in FIG. 1.

First ice tray 11 is molded of polypropylene of plastic resin. Ice tray 11 has a plurality of depressed areas 11A for determining an ice shape, depressed area frame 11B for collectively fixing depressed areas 11A, and shaft 11C formed at an end of the longitudinal central axis of depressed area frame 11B.

Second ice tray 12 is molded of polypropylene similarly to ice tray 11, and has depressed areas 12A, depressed area frame 12B, and shaft 12C.

Ice tray driving device (this is hereinafter called driving device) 13 holds shafts 11C and 12C of respective ice trays 11 and 12, and turns ice trays 11 and 12 if necessary to separate ice from the trays. A motor as a driving source and a reduction gear for decelerating and transmitting rotation of the motor are disposed in driving device 13.

Ice box 14 is disposed under ice trays 11 and 12 and stores the separated ice. The inside of ice box 14 includes partition (first ice storing section) 141 for storing ice supplied from ice tray 11 and partition (second ice storing section) 142 for storing ice supplied from ice tray 12.

First ice detecting lever 151 detects an amount of the ice stored in partition 141 in ice box 14. Second ice detecting lever 152 detects an amount of the ice stored in partition 142.

Tank 16 stores water to be supplied to ice trays 11 and 12. Water supply system 17 supplies the water in tank 16 to ice trays 11 and 12. Water supply system 17 has first pipe 171 for guiding water to ice tray 11, second pipe 172 for guiding water to ice tray 12, pump 173 for taking water out of tank 16, and switching valve 174 for changing the flow channel of the water supplied from pump 173. Controller 18 controls driving device 13 and water supply system 17. Ice trays 11 and 12 and ice box 14 are disposed in ice making room 6. Ice making room 6 is connected to cooler 9 for cooling air sucked from intake duct 8 and exhausting it through discharge duct 7. Water in ice trays 11 and 12 is cooled by cooler 9 via cold air. The cooler for cooling water in ice trays 11 and 12 may employ a method other than the method using the cold air.

Ice trays 11 and 12, driving device 13, ice box 14, ice detecting levers 151 and 152, tank 16, water supply system 17, controller 18, and cooler 9 constitute automatic ice-making machine 19.

Figure 3:
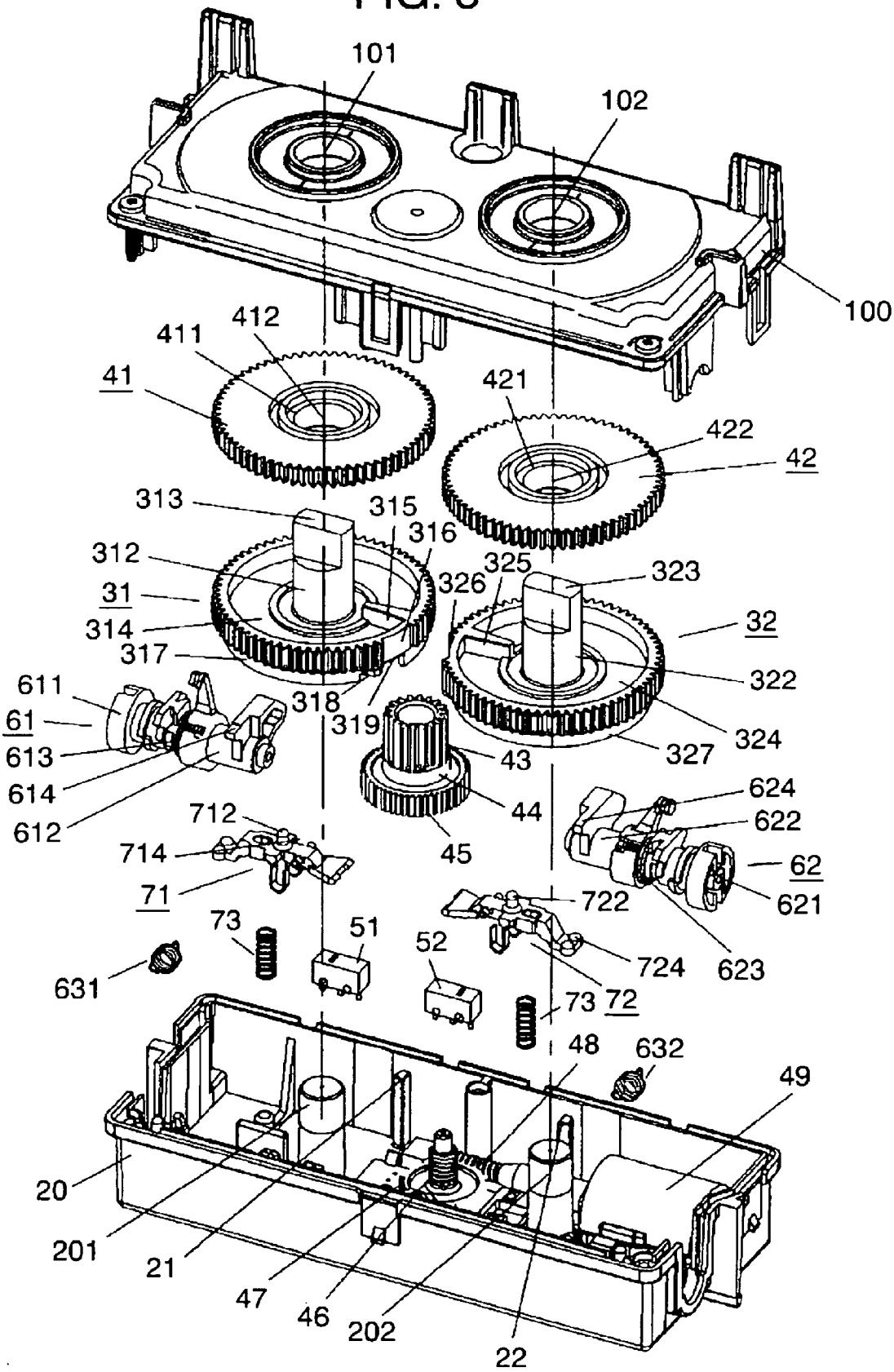
FIG. 3 is an exploded perspective view of the ice tray driving device in accordance with the exemplary embodiment.
Figure 4:
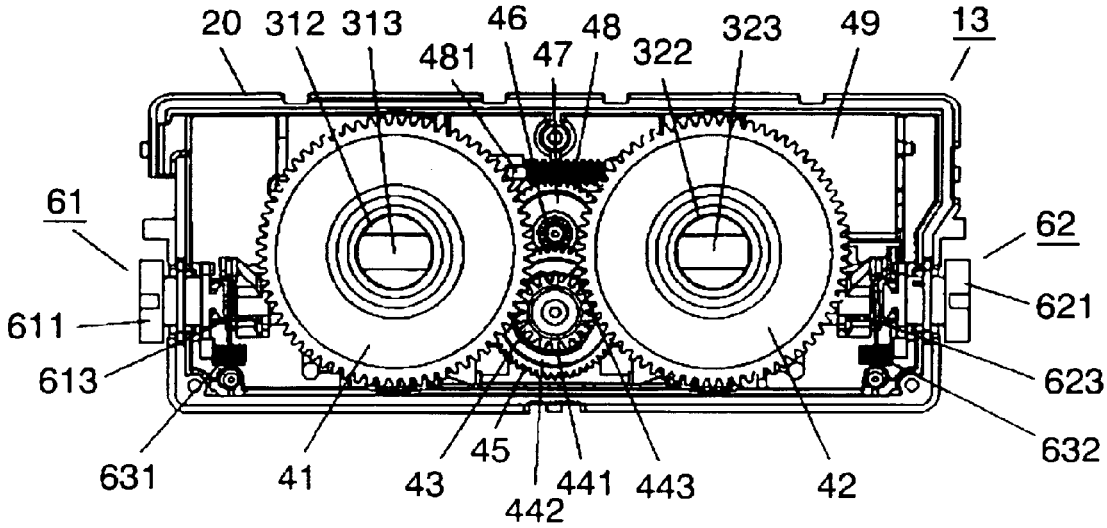
FIG. 4 is a plan view of the inside of the ice tray driving device in accordance with the exemplary embodiment.
Figure 5:
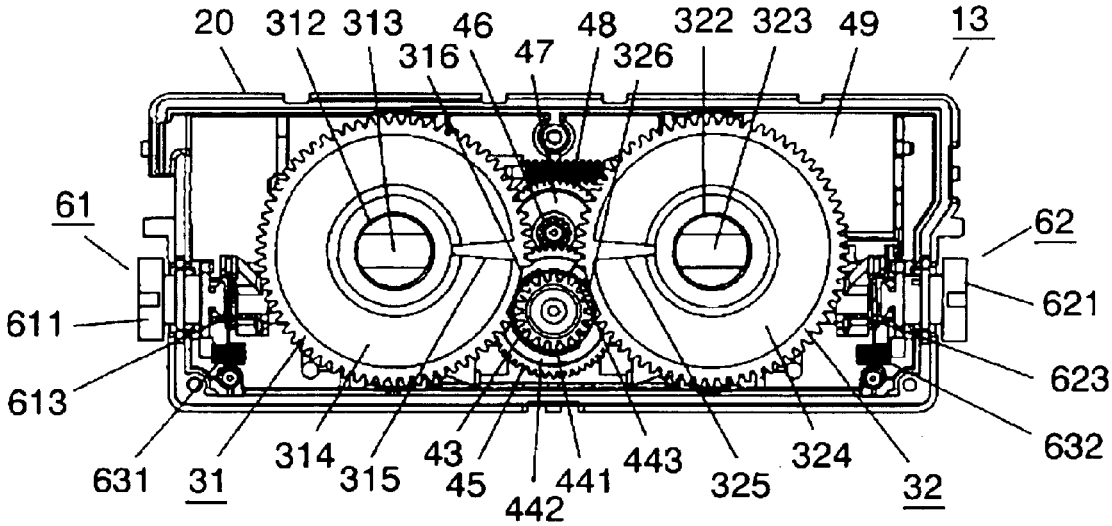
FIG. 5 is a plan view of a state where a first transmission gear and a second transmission gear are removed from the ice tray driving device of FIG. 4.

The inner structure of driving device 13 is then described. FIG. 3 is an exploded perspective view of the ice tray driving device in accordance with the exemplary embodiment. FIG. 4 is a plan view of the ice tray driving device. FIG. 5 is a plan view of a state where a part is removed from the plan view of FIG. 4.

Case 20 forms the outer shell of driving device 13, and is a molded body of acrylonitrile-butadiene-styrene (ABS), namely plastic resin. A central part of case 20 is provided with two columnar bosses 201 and 202.

First abutting wall 21 forming a first abutting section is disposed on a side wall of case 20 close to first output gear 31. Second abutting wall 22 forming a second abutting section is disposed on a side wall of case 20 close to second output gear 32.

Figure 6A:
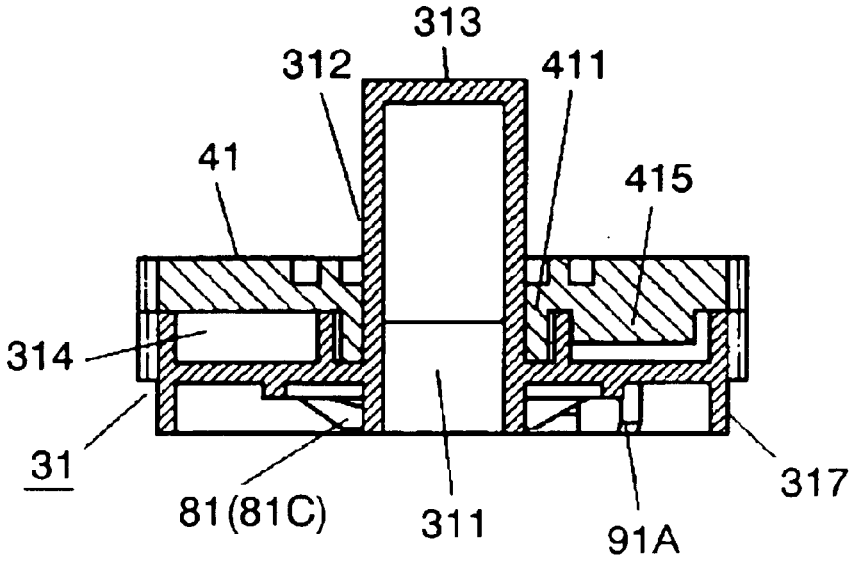
FIG. 6A is a sectional view of a first output gear and the first transmission gear in accordance with the exemplary embodiment.

First output gear 31 is rotatably supported by columnar boss 201. The center of output gear 31 has shaft hole 311 recessed cylindrically in a view from case 20 side as shown in FIG. 6A, and columnar boss 201 of case 20 engages with shaft hole 311.

Cylindrical shaft 312 projects from the center of output gear 31 toward ice tray 11. Output shaft 313 to be coupled to shaft 11C of ice tray 11 also projects from cylindrical shaft 312.

Between the gear of output gear 31 and cylindrical shaft 312, recessed section 314 is formed so as to surround cylindrical shaft 312, and working surface 315 radially going across the inside of recessed section 314 is formed.

The gear of output gear 31 also has first toothless section 316 where a plurality of teeth are removed.

Output gear 31 also has cylindrical first circumferential wall (hereinafter, wall) 317 axially adjacent to the gear section, and the outer diameter of wall 317 is set at the bottom circle diameter of the gear or shorter.

First raised tooth 318 is formed on wall 317. Tooth 318 projects from a side surface of the tooth adjacent to toothless section 316 in the tooth width direction, and projects radially to an extent where raised tooth 318 does not exceed the tip of the gear.

First notch 319 is formed by removing a part of wall 317 that is axially adjacent to first toothless section 316 and raised tooth 318.

Figure 15:
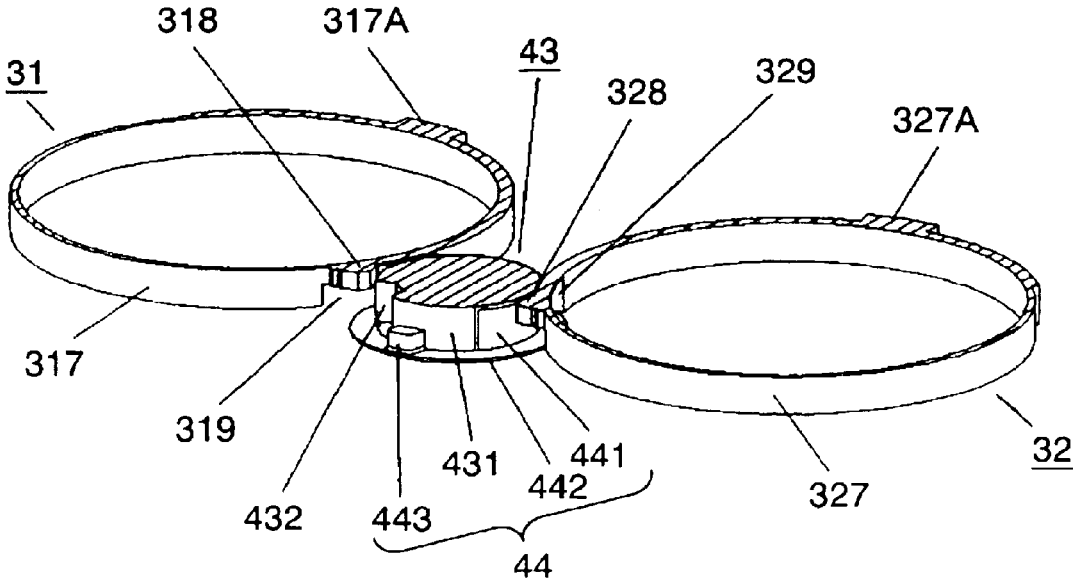
FIG. 15 is a perspective view of a first circumferential wall, a second circumferential wall, and a column section that are cut by the same cutting plane in accordance with the exemplary embodiment.

First abutting raised section 317A forming the first abutting section is formed on wall 317 at a position adjacent to first abutting wall 21 of case 20 as shown in FIG. 15.

Figure 6B:
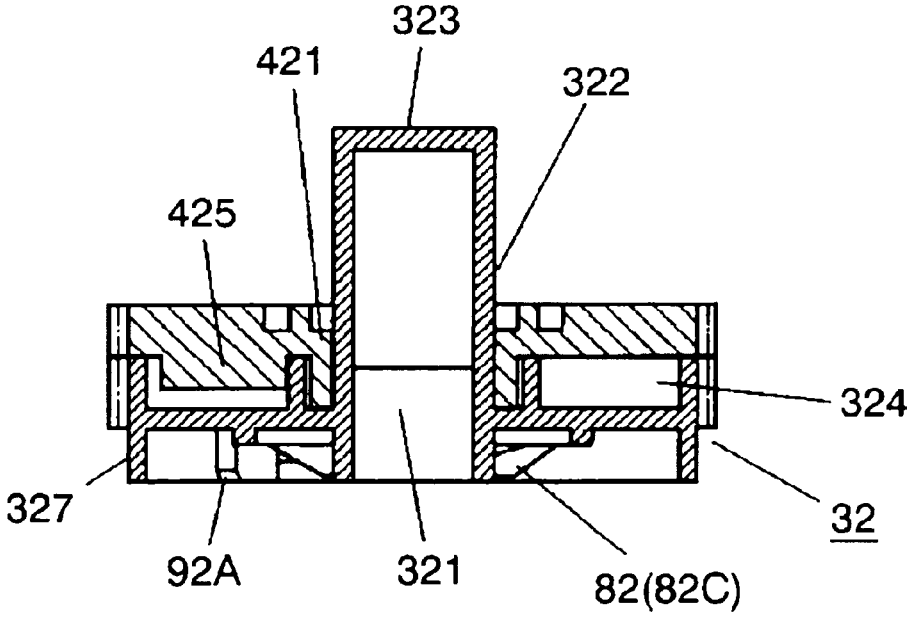
FIG. 6B is a sectional view of a second output gear and the second transmission gear in accordance with the exemplary embodiment.

Second output gear 32 is rotatably supported by columnar boss 202 of case 20. The center of output gear 32 has shaft hole 321 recessed cylindrically in a view from the case 20 side as shown in FIG. 6B, and columnar boss 202 of case 20 engages with shaft hole 321.

Cylindrical shaft 322 projects from the center of output gear 32 toward ice tray 12. Output shaft 323 to be coupled to shaft 12C of ice tray 12 also projects from cylindrical shaft 322.

Between the gear of output gear 32 and cylindrical shaft 322, recessed section 324 is formed so as to surround cylindrical shaft 322, and working surface 325 radially going across the inside of recessed section 324 is formed.

The gear of output gear 32 also has second toothless section 326 where a plurality of teeth are removed.

Output gear 32 also has second circumferential wall (hereinafter, wall) 327 axially adjacent to the gear section, and the outer diameter of wall 327 is set at the bottom circle diameter of the gear or shorter.

Second raised tooth 328 is formed on wall 327. Tooth 328 projects from a side surface of the tooth adjacent to toothless section 326 in the tooth width direction, and projects radially to an extent where raised tooth 328 does not exceed the tip of the gear.

Second notch 329 is formed by removing a part of wall 327 that is axially adjacent to second toothless section 326 and raised tooth 328.

Second abutting raised section 327A forming the second abutting section is formed on wall 327 at a position adjacent to second abutting wall 22 of case 20.

First transmission gear 41 rotates coaxially with output gear 31. The side of transmission gear 41 facing to output gear 31 has cylindrical shaft 411 and shaft hole 412 penetrating through the center of cylindrical shaft 411. Shaft hole 412 engages with cylindrical shaft 312 of output gear 31. The side of transmission gear 41 facing to output gear 31 also has sectorial raised section 415 extending axially.

When transmission gear 41 is rotating and raised section 415 is traveling in recessed section 314 of output gear 31, output gear 31 is at rest. After raised section 415 of transmission gear 41 abuts on working surface 315 of output gear 31, transmission gear 41 and output gear 31 rotate coaxially together.

Second transmission gear 42 rotates coaxially with output gear 32. The side of transmission gear 42 facing to output gear 32 has cylindrical shaft 421 and shaft hole 422 penetrating through the center of cylindrical shaft 421. Shaft hole 422 engages with cylindrical shaft 322 of output gear 32. The side of transmission gear 42 facing to output gear 32 also has sectorial raised section 425 extending axially.

When transmission gear 42 is rotating and raised section 425 is traveling in recessed section 324 of output gear 32, output gear 32 is at rest. After raised section 425 of transmission gear 42 abuts on working surface 325 of output gear 32, transmission gear 42 and output gear 32 rotate coaxially together.

Driving gear 43 is disposed between output gear 31 and output gear 32 so that the rotation axes of the three gears form a triangle. Driving gear 43 engages with both output gear 31 and output gear 32. In a reference position state, driving gear 43 faces to both toothless section 316 of output gear 31 and toothless section 326 of output gear 32, but does not mesh with any one of output gear 31 and output gear 32.

While, transmission gear 41 coaxial with output gear 31 and transmission gear 42 coaxial with output gear 32 have no toothless section, so that transmission gears 41 and 42 always mesh with driving gear 43. When driving gear 43 is rotating, transmission gears 41 and 42 always rotate in the same direction.

Driving gear 43 has column section 431 coaxially adjacent to the gear, and column section 431 has recessed tooth 432 formed by extending one tooth trough of driving gear 43 as shown in FIG. 15.

Column section 431 is provided with slide member 44. Slide member 44 covers recessed tooth 432. When driving gear 43 rotates, slide member 44 rotates with column section 431 by a predetermined angle and then slide-contacts with column section 431.

Slide member 44 has semicylinder 441, collar 442, and contact piece 443. Semicylinder 441 covers the outer surface of column section 431 by more than half and slidably contacts with the outer surface. Collar 442 extends radially from an end of semicylinder 441. Contact piece 443 is disposed on collar 442 and on the opposite side to semicylinder 441. Contact piece 443 abuts on and slide-contacts with one of wall 317 and wall 327.

Figure 16A:
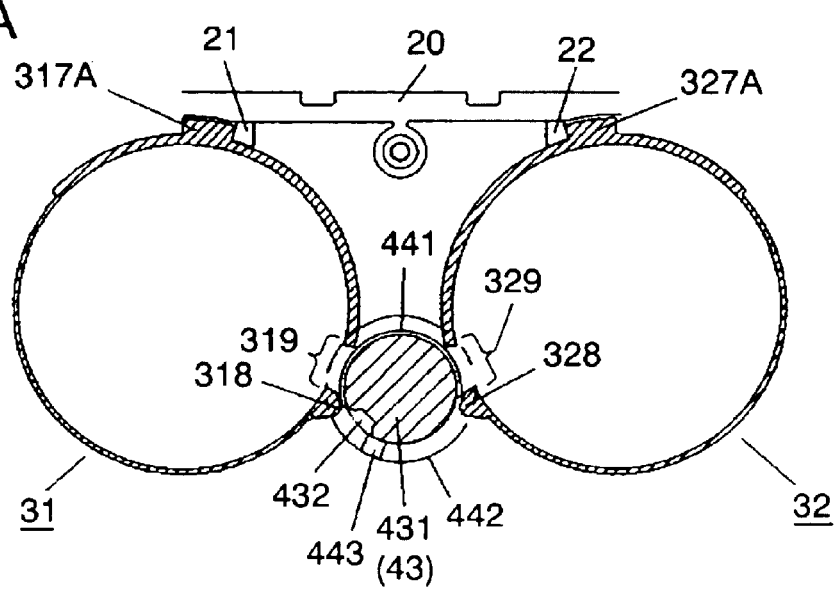
FIG. 16A is a plan view of a state just before meshing of a first raised tooth with a recessed tooth in accordance with the exemplary embodiment.
Figure 16B:
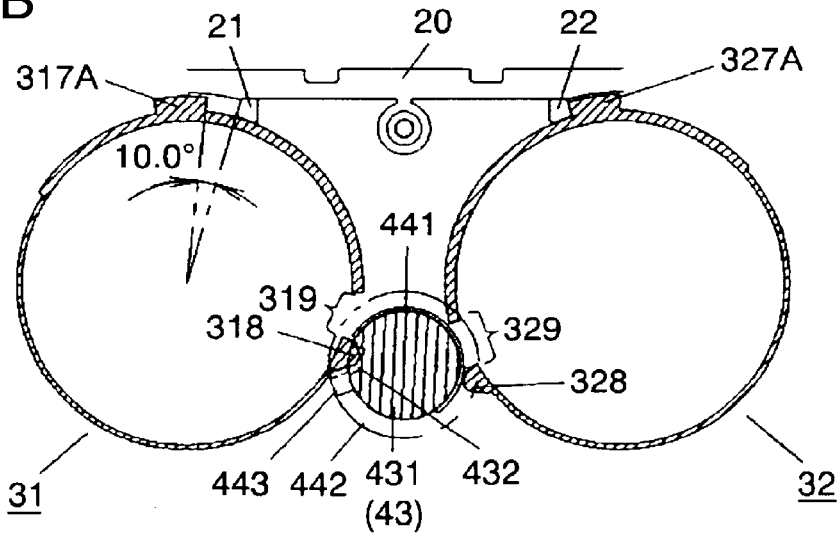
FIG. 16B is a plan view of a meshing state of the first raised tooth with the recessed tooth in accordance with the exemplary embodiment.
Figure 16C:
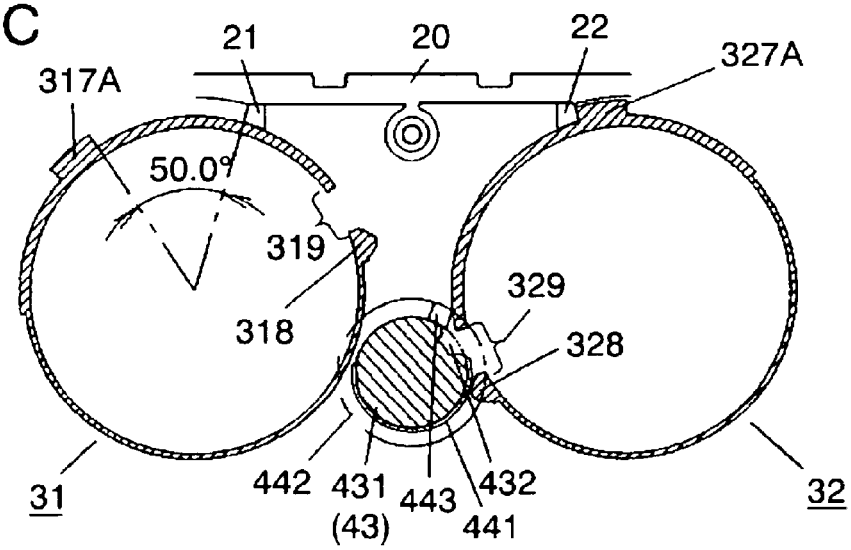
FIG. 16C is a plan view of a released state of the meshing of the first raised tooth with the recessed tooth in accordance with the exemplary embodiment.

When driving gear 43 rotates output gear 31 from the reference position, contact piece 443 of slide member 44 travels to wall 327 through notch 319 to stop. Contact piece 443 blocks recessed tooth 432 of column section 431 with respect to raised tooth 328 of output gear 32 to prevent meshing of recessed tooth 432 with raised tooth 328 (FIG. 16A to FIG. 16C).

Figure 17A:
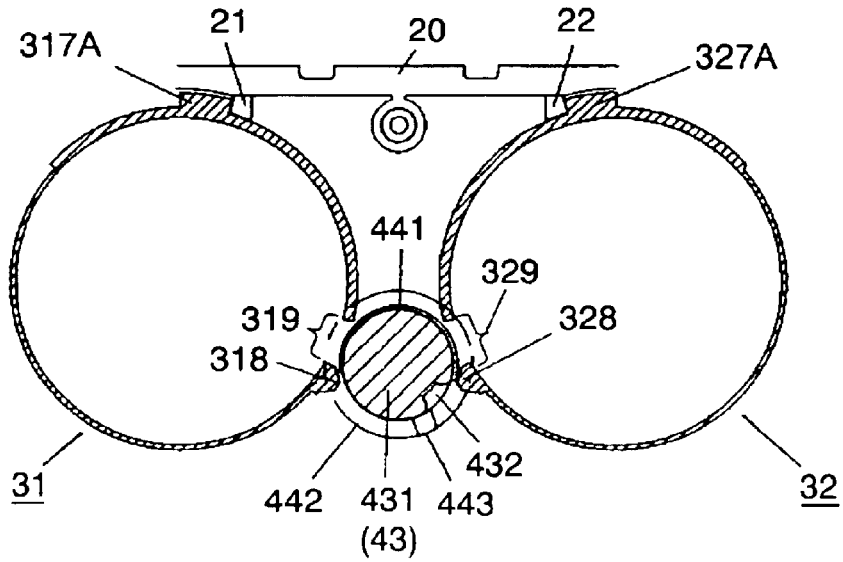
FIG. 17A is a plan view of a state just before meshing of a second raised tooth with the recessed tooth in accordance with the exemplary embodiment.
Figure 17B:
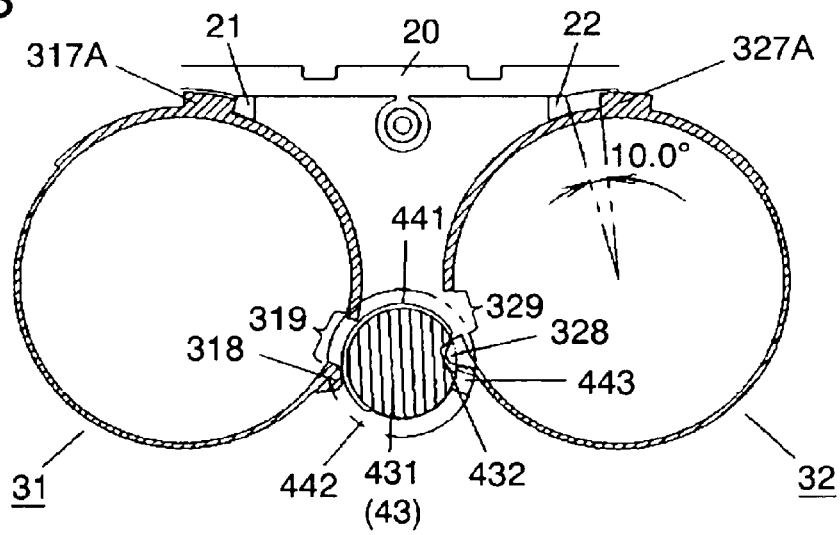
FIG. 17B is a plan view of a meshing state of the second raised tooth with the recessed tooth in accordance with the exemplary embodiment.
Figure 17C:
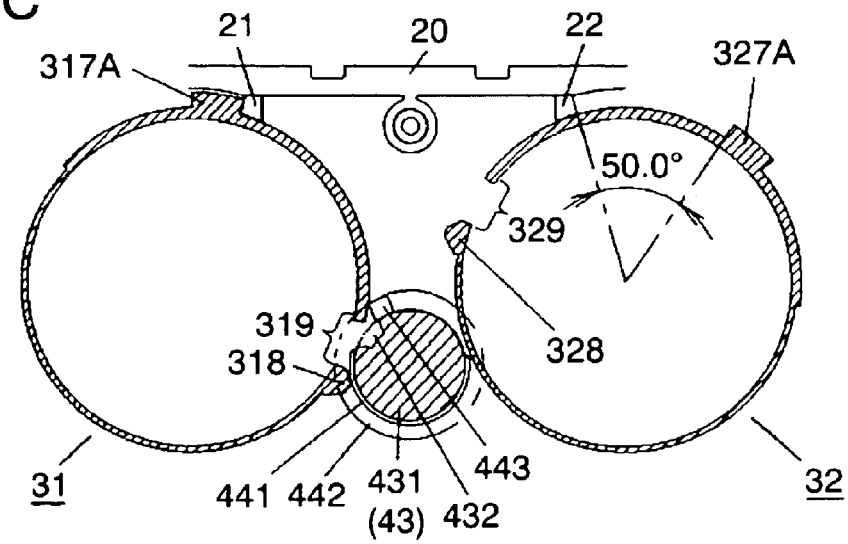
FIG. 17C is a plan view of a released state of the meshing of the second raised tooth with the recessed tooth in accordance with the exemplary embodiment.

When driving gear 43 rotates output gear 32 from the reference position, contact piece 443 of slide member 44 travels to wall 317 through notch 329 to stop. Contact piece 443 blocks recessed tooth 432 of column section 431 with respect to raised tooth 318 of output gear 31 to prevent meshing of recessed tooth 432 with raised tooth 318 (FIG. 17A to FIG. 17C).

Raised teeth 318 and 328, column section 431, recessed tooth 432, and slide member 44 constitute a mesh start section.

Gear 45 is unitarily molded coaxially with driving gear 43. Pinion gear 46 meshes with gear 45. Gear 47 is unitarily molded coaxially with driving pinion gear 46.

Worm gear 48 meshes with gear 47. Worm gear 48 has shaft 481 at an end of its rotating axis and a rectangular hole at the other end of the rotating axis. Shaft 481 is supported by a bearing disposed in case 20. The hole engages with a rectangular coupling plate (not shown) pressed into a shaft (not shown) of motor 49. When motor 49 rotates, the coupling plate rotates to transmit the rotation of motor 49 to worm gear 48. The rotation of motor 49 is therefore transmitted to the shaft, the coupling plate, worm gear 48, gear 47, pinion gear 46, gear 45, driving gear 43, transmission gears 41 and 42, and output gears 31 and 32 in that order.

Under parts of output gears 31 and 32 of the present embodiment are then described.

Figure 7:
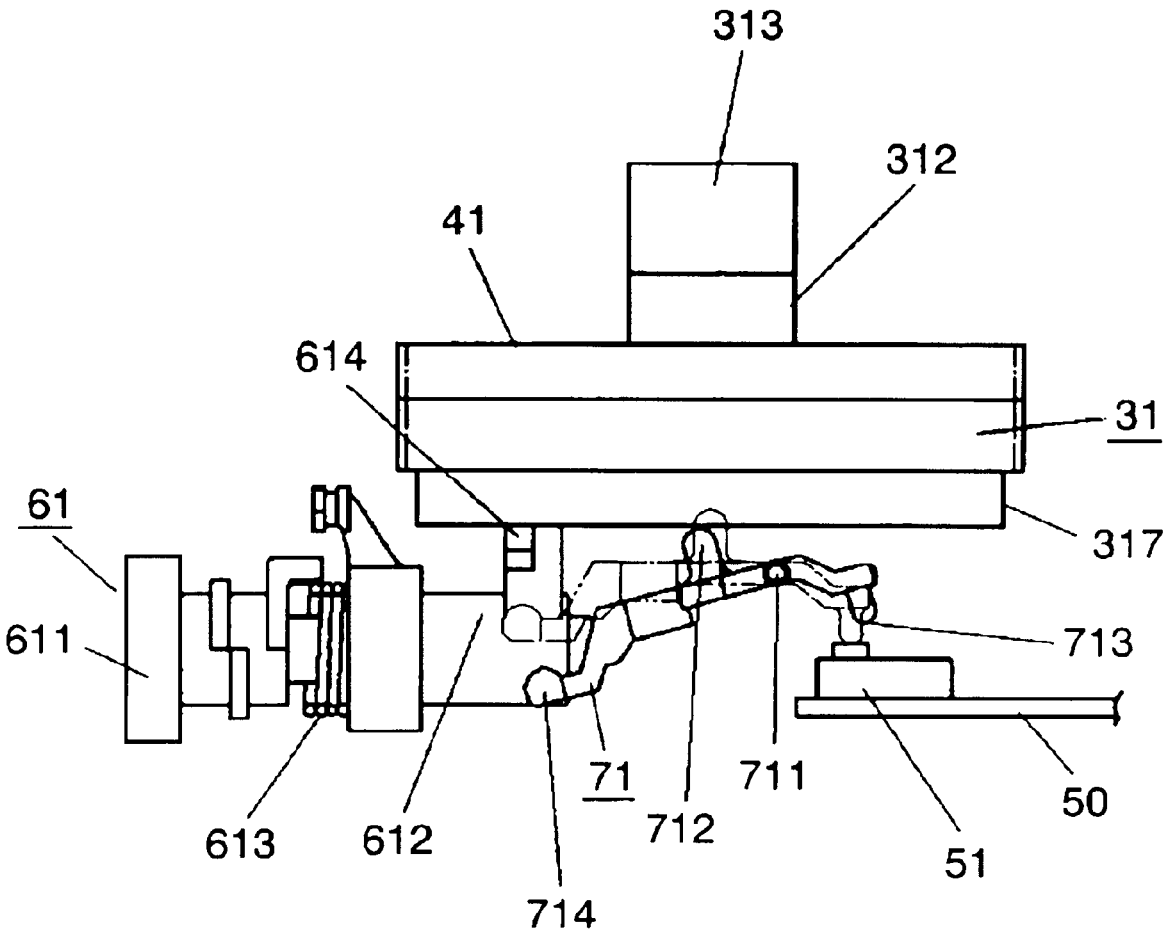
FIG. 7 is a front view of the downside of the first output gear in accordance with the exemplary embodiment.
Figure 9:
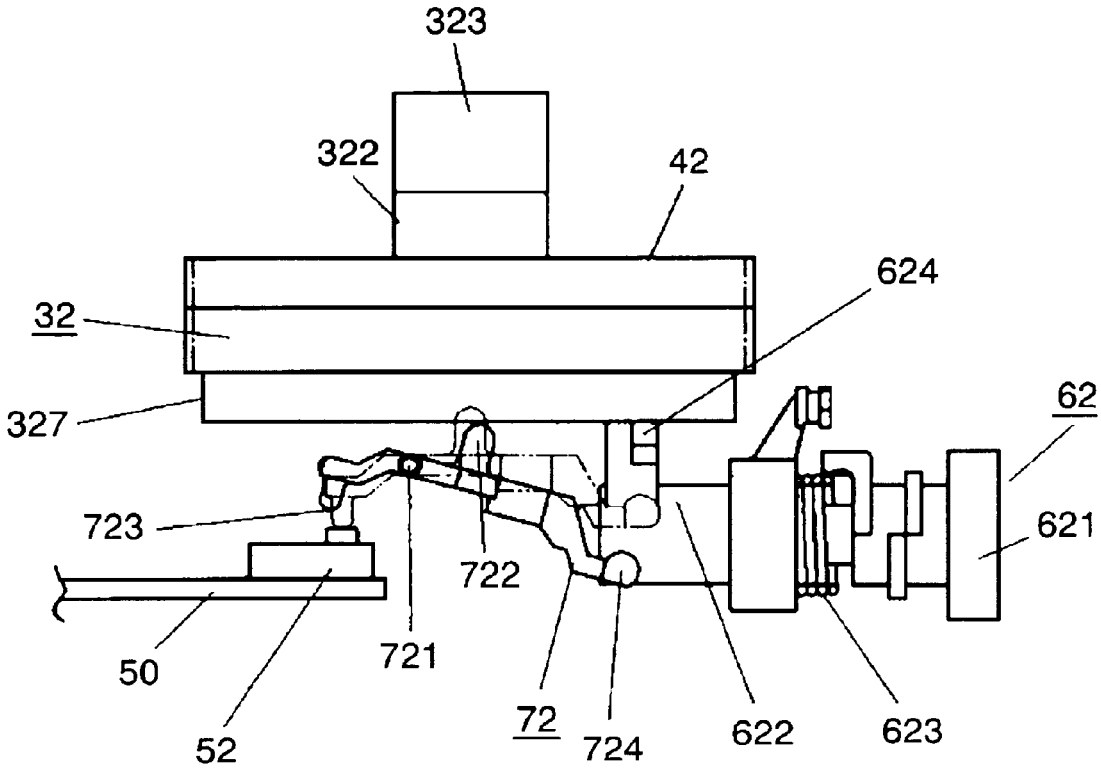
FIG. 9 is a front view of the downside of the second output gear in accordance with the exemplary embodiment.

In FIGS. 7 and 9, substrate 50 is held in case 20. Switch 51 is soldered under output gear 31, and switch 52 is soldered under output gear 32. Substrate 50 is connected to motor 49 through two lead wires (not shown). A harness (not shown) that extends through an opening formed in one side surface of case 20 along the bottom surface of case 20 and goes out of case 20 is soldered to substrate 50. The harness is connected to controller 18.

First ice detecting shaft (hereinafter, shaft) 61 is turned by output gear 31. Shaft 61 has outer shaft 611, inner shaft 612, torsion coil spring 613, and block section 614. Outer shaft 611 is coupled to ice detecting lever 151. Inner shaft 612 is driven by output gear 31. Torsion coil spring 613 couples outer shaft 611 with inner shaft 612. Block section 614 blocks an operation of first switch lever 71 when ice in partition 141 of ice box 14 is less than a predetermined amount.

Second ice detecting shaft (hereinafter, shaft) 62 is turned by output gear 32. Shaft 62 has outer shaft 621, inner shaft 622, torsion coil spring 623, and block section 624. Outer shaft 621 is coupled to ice detecting lever 152. Inner shaft 622 is driven by output gear 32. Torsion coil spring 623 couples outer shaft 621 to inner shaft 622. Block section 624 blocks an operation of second switch lever 72 when ice in partition 142 of ice box 14 is less than a predetermined amount.

First spring 631 is a helical extension spring disposed on the shaft 61 side, and second spring 632 is a helical extension spring disposed on the second ice detecting shaft 62 side. Spring 631 is disposed between shaft 61 and case 20 so that its tension moves lever 151 coupled to shaft 61 into partition 141 of ice box 14. Spring 632 is disposed between shaft 62 and case 20 so that its tension moves lever 152 coupled to shaft 62 into partition 142 of ice box 14. This structure forms an ice detecting section.

First switch lever (hereinafter, lever) 71 lies under output gear 31, is driven by output gear 31, and operates first switch 51.

When ice tray 11 lies at a horizontal position or an ice separation position, or when lever 151 goes into partition 141 by more than a predetermined depth, lever 71 makes switch 51 to generate an OFF signal. The latter state means shortage of ice in partition 141 of ice box 14.

Figure 8A:
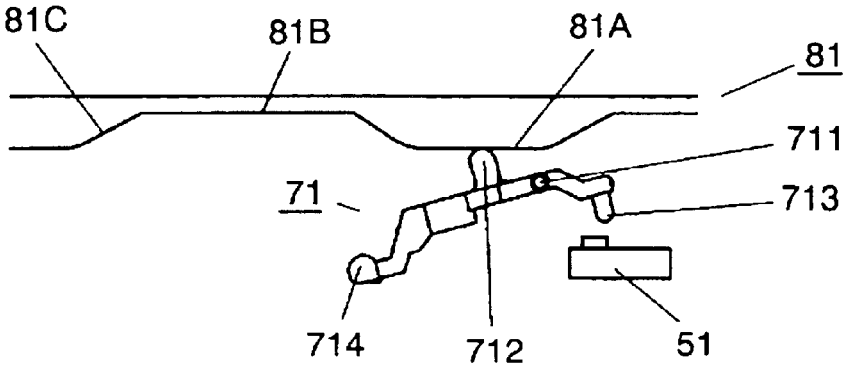
FIG. 8A is a front view showing a state of a first outer cam formed on the lower surface of the first output gear, and a first switch lever when a first ice tray lies at a horizontal position in accordance with the exemplary embodiment.
Figure 8B:
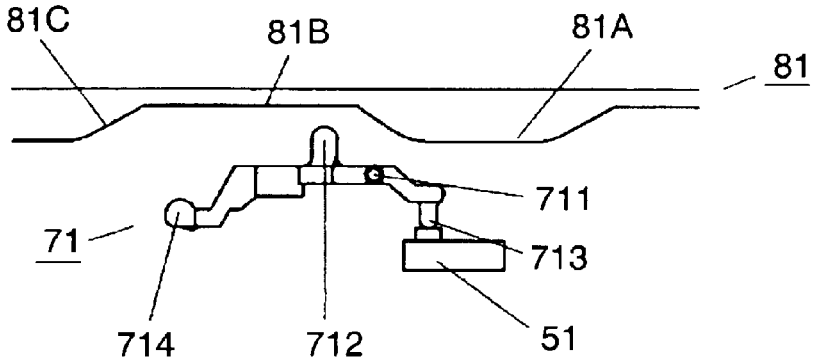
FIG. 8B is a front view showing a state of the first outer cam formed on the lower surface of the first output gear, and the first switch lever when the first ice tray lies at 45° counterclockwise in accordance with the exemplary embodiment.
Figure 8C:
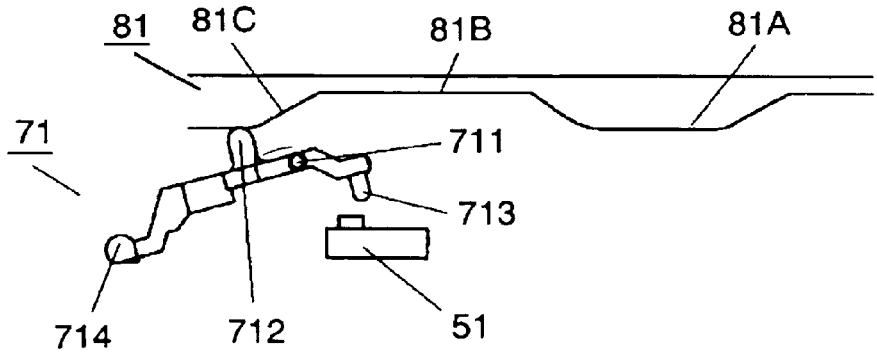
FIG. 8C is a front view showing a state of the first outer cam formed on the lower surface of the first output gear, and the first switch when the first ice tray lies at an ice separation position in accordance with the exemplary embodiment.

Lever 71 has rotating shaft 711 and three projections 712, 713, and 714. Projection 712 contacts with and is driven by outer cam 81 as shown in FIG. 8A to FIG. 8C. Projection 713 operates switch 51 in cooperation with a displacement of projection 712. Projection 714 abuts on block section 614 of shaft 61. When ice is lacking, block section 614 presses projection 714 to prevent projection 713 from operating switch 51.

Second switch lever (hereinafter, lever) 72 lies under output gear 32, is driven by output gear 32, and operates second switch 52.

When ice tray 12 lies at a horizontal position or an ice separation position, or when lever 152 goes into partition 142 by more than a predetermined depth, lever 72 makes switch 52 to generate an OFF signal.

Figure 10A:
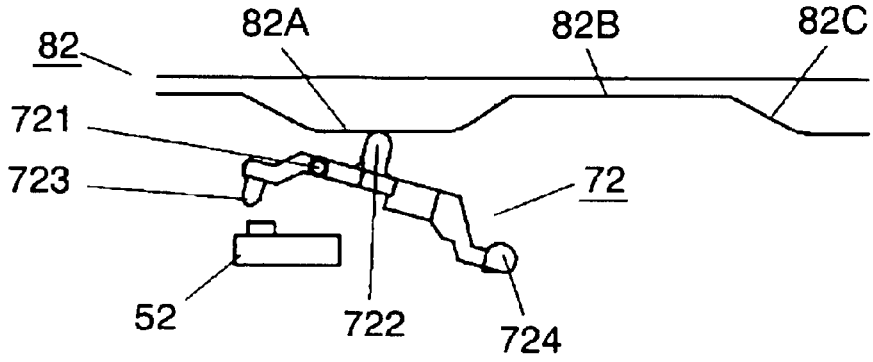
FIG. 10A is a front view showing a state of a second outer cam formed on the lower surface of the second output gear, and a second switch lever when a second ice tray lies at a horizontal position in accordance with the exemplary embodiment.
Figure 10B:
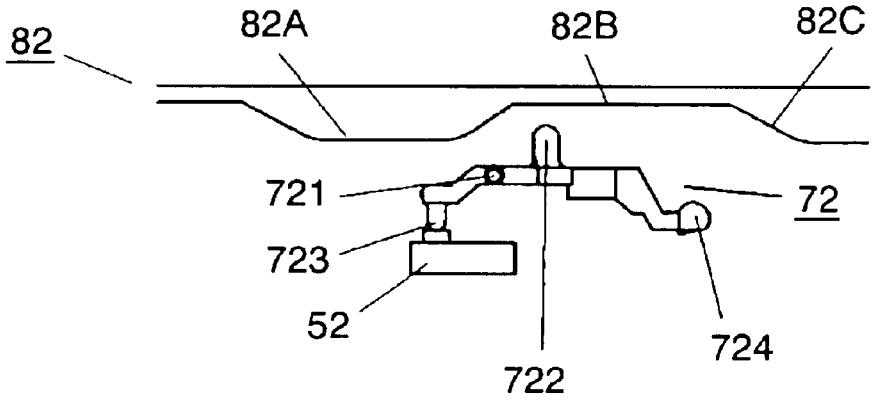
FIG. 10B is a front view showing a state of the second outer cam formed on the lower surface of the second output gear, and the second switch lever when the second ice tray lies at 45° clockwise in accordance with the exemplary embodiment.
Figure 10C:
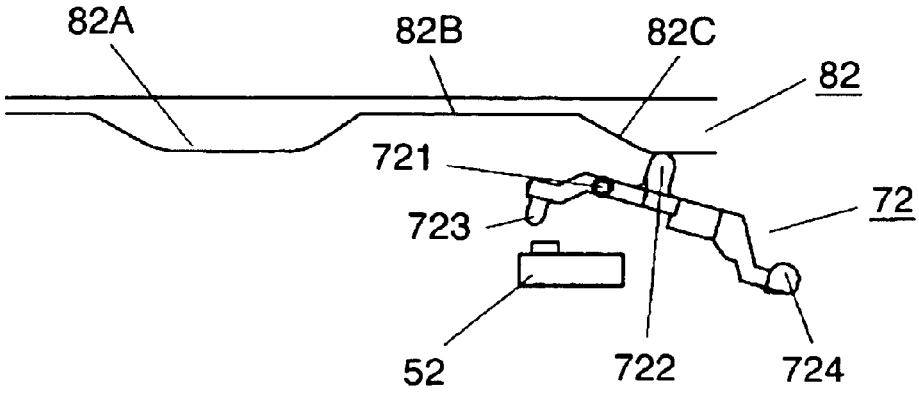
FIG. 10C is a front view showing a state of the second outer cam formed on the lower surface of the second output gear, and the second switch lever when the second ice tray lies at an ice separation position in accordance with the exemplary embodiment.

Lever 72 has rotating shaft 721 and three projections 722, 723, and 724. Projection 722 contacts with and is driven by second outer cam 82 as shown in FIG. 10A to FIG. 10C. Projection 723 operates switch 52 in cooperation with a displacement of projection 722. Projection 724 abuts on block section 624 of shaft 62. When ice is lacking, block section 624 presses projection 724 to prevent projection 723 from operating switch 52.

Coil springs 73 exert energizing force to switch levers 71 and 72.

In FIG. 8A to FIG. 8C, first outer cam 81 is unitarily formed on the lower surface of output gear 31, and operates lever 71 lying under output gear 31. Outer cam 81 operates projection 712 of lever 71, and has raised section 81A and raised section 81C for making switch 51 to generate an OFF signal and recessed section 81B for making switch 51 to generate an ON signal.

In FIG. 10A to FIG. 10C, second outer cam 82 is unitarily formed on the lower surface of output gear 32, and operates lever 72 lying under output gear 32. Outer cam 82 operates projection 722 of lever 72, and has raised section 82A and raised section 82C for making switch 52 to generate an OFF signal and recessed section 82B for making switch 52 to generate an ON signal. Outer cams 81 and 82, switch levers 71 and 72, and the like constitute an ice tray position detecting section.

Figure 12A:
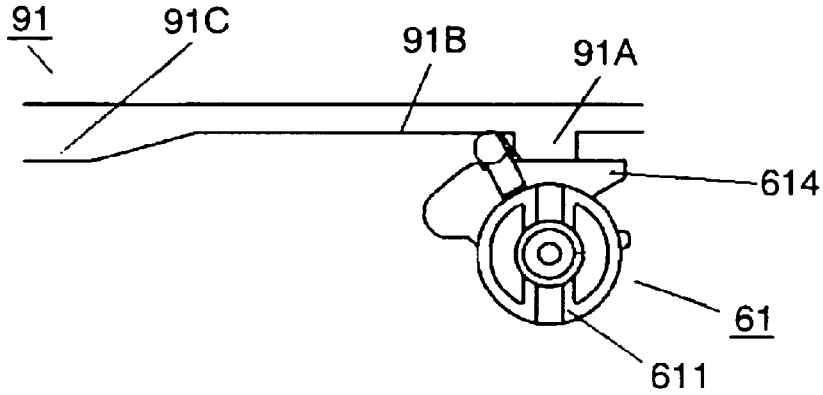
FIG. 12A is a front view showing a state of a first inner cam formed on the lower surface of the first output gear, and the first ice detecting shaft when the first ice tray lies at a horizontal position in accordance with the exemplary embodiment.
Figure 12B:
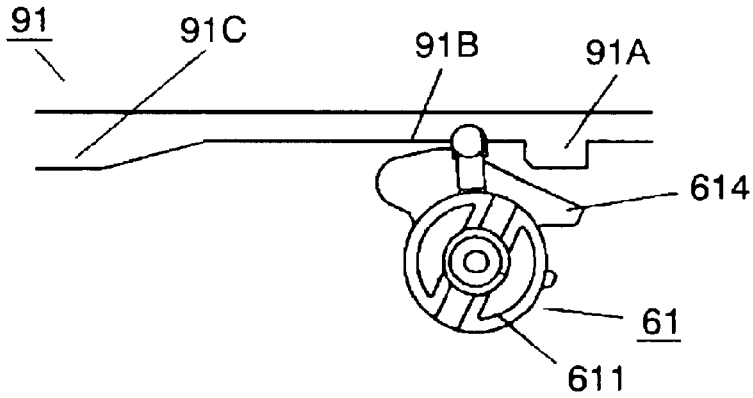
FIG. 12B is a front view showing a state of the first inner cam formed on the lower surface of the first output gear, and the first ice detecting shaft when the first ice tray lies at 45° counterclockwise in accordance with the exemplary embodiment.
Figure 12C:
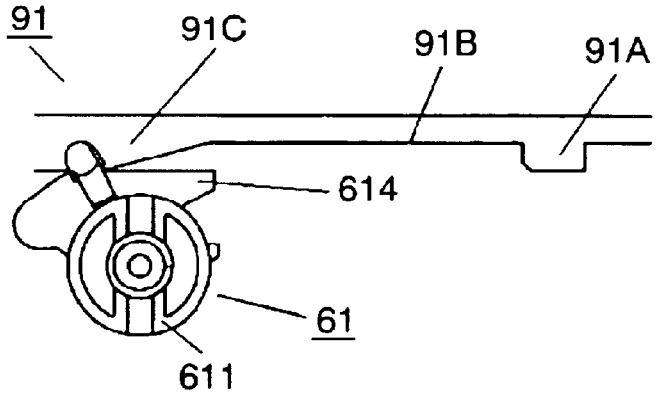
FIG. 12C is a front view showing a state of the first inner cam formed on the lower surface of the first output gear, and the first ice detecting shaft when the first ice tray lies at an ice separation position in accordance with the exemplary embodiment.

In FIG. 12A to FIG. 12C, first inner cam 91 is unitarily formed on the lower surface of output gear 31. First inner cam 91 has raised section 91A, recessed section 91B, and raised section 91C. Raised section 91A supports shaft 61 so as to make lever 151 stand by above ice box 14. Recessed section 91B releases lever 151 from the standby state, and allows turning of shaft 61 so as to allow lever 151 to go into ice box 14. Raised section 91C turns shaft 61 so as to withdraw lever 151 to an above part of partition 141 of ice box 14.

Figure 14A:
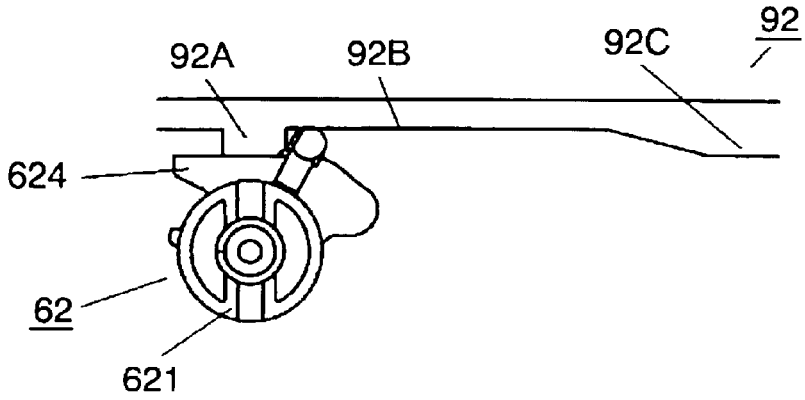
FIG. 14A is a front view showing a state of a second inner cam formed on the lower surface of the second output gear, and the second ice detecting shaft when the second ice tray lies at a horizontal position in accordance with the exemplary embodiment.
Figure 14B:
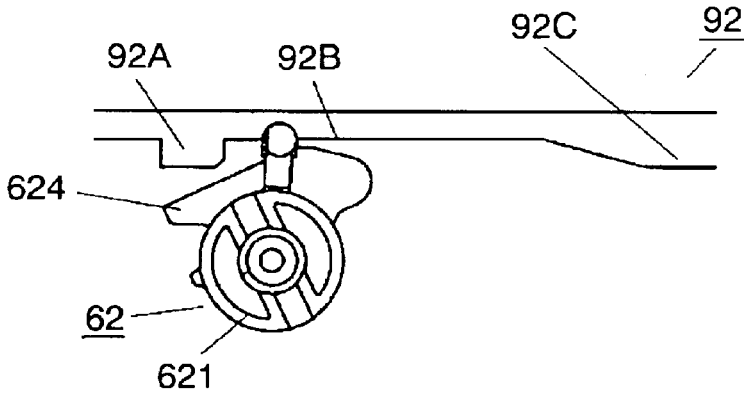
FIG. 14B is a front view showing a state of the second inner cam formed on the lower surface of the second output gear, and the second ice detecting shaft when the second ice tray lies at 45° counterclockwise in accordance with the exemplary embodiment.
Figure 14C:
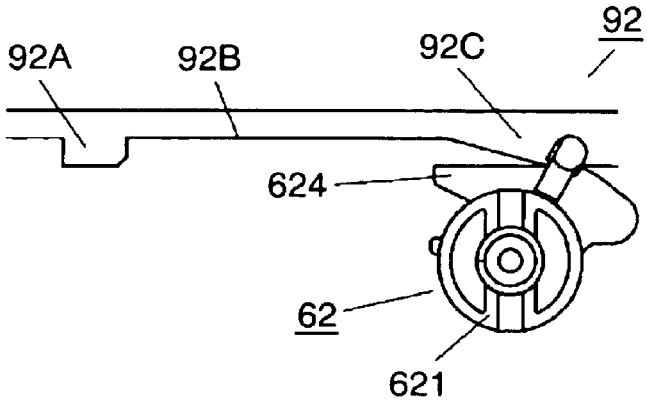
FIG. 14C is a front view showing a state of the second inner cam formed on the lower surface of the second output gear, and the second ice detecting shaft when the second ice tray lies at an ice separation position in accordance with the exemplary embodiment.

In FIG. 14A to FIG. 14C, second inner cam 92 is unitarily formed on the lower surface of output gear 32. Second inner cam 92 has raised section 92A, recessed section 92B, and raised section 92C. Raised section 92A supports shaft 62 so as to make lever 152 stand by above ice box 14. Recessed section 92B releases lever 152 from the standby state, and allows turning of shaft 62 so as to allow lever 152 to go into ice box 14. Raised section 92C turns shaft 62 so as to withdraw lever 152 to an above part of partition 142 of ice box 14.

Cover 100 and case 20 form an outer shell of driving device 13. Shaft hole 101 to be engaged with cylindrical shaft 312 of output gear 31 and shaft hole 102 to be engaged with cylindrical shaft 322 of output gear 32 are disposed near the center of cover 100.

FIG. 15 is a perspective view of wall 317, wall 327, and column section 431 that are cut by the same cutting plane when output gear 31, output gear 32, and driving gear 43 lie at reference positions. Raised tooth 318 and notch 319 face to column section 431, and raised tooth 318 abuts on the outer periphery of column section 431 or semicylinder 441 of slide member. 44. Output gear 31 does not therefore rotate counterclockwise. First abutting wall 21 of case 20 abuts on first abutting raised section 317A as shown in FIG. 16A, so that output gear 31 does not rotate clockwise. Therefore, output gear 31 does not rotate either clockwise or counterclockwise at the reference position, so that output gear 31 does not oscillate to keep ice tray 11 at the horizontal position.

Similarly, in FIG. 15, raised tooth 328 and notch 329 face to column section 431, and raised tooth 328 abuts on the outer periphery of column section 431 or semicylinder 441 of slide member 44. Output gear 32 does not therefore rotate clockwise. Second abutting wall 22 of case 20 abuts on second abutting raised section 327A as shown in FIG. 17A, so that output gear 32 does not rotate counterclockwise in FIG. 15. Therefore, output gear 32 does not rotate either clockwise or counterclockwise at the reference position, so that output gear 32 does not oscillate to keep ice tray 12 at the horizontal position.

At the reference position, as shown in FIG. 15, slide member 44 is on standby in a state where semicylinder 441 is contacting with column section 431 of driving gear 43. Contact piece 443 of slide member 44 is on standby at arbitrary position between wall 317 and wall 327.

Operations of the ice tray driving device having such a structure in an automatic ice-making machine are described with reference to drawings.

When motor 49 is started, worm gear 48 rotates. The rotation of worm gear 48 is transmitted to driving gear 43 via worm wheel gear 47, pinion gear 46, and gear 45.

An operation of separating ice from ice tray 11 is described with reference to FIG. 3, FIG. 6A, FIGS. 16A to 16C, and FIGS. 18A to 18C.

When driving device 13 separates ice from ice tray 11, driving device 13 rotates motor 49 to rotate driving gear 43 clockwise. When driving gear 43 is rotated clockwise, transmission gear 41 meshing with driving gear 43 starts to rotate counterclockwise. Raised section 415 of transmission gear 41 abuts on working surface 315 of output gear 31, and transmission gear 41 and output gear 31 start to rotate together. At the reference position shown in FIG. 16A, recessed tooth 432 of column section 431 is not blocked, so that recessed tooth 432 meshes with raised tooth 318 of output gear 31. Thus, meshing of driving gear 43 with output gear 31 is established, and output gear 31 starts to rotate in the ice separating direction, as shown in FIG. 16B. Contact piece 443 of slide member 44 then travels through notch 319 in wall 317 of output gear 31, and abuts on the outer periphery of wall 327 of output gear 32 to stop, as shown in FIG. 16C.

When slide member 44 stops, semicylinder 441 directs its outer periphery toward raised tooth 328 of output gear 32. In other words, semicylinder 441 blocks recessed tooth 432 with respect to raised tooth 328, and opens recessed tooth 432 with respect to raised tooth 318.

While driving gear 43 rotates clockwise, output gear 31 turns ice tray 11 in the ice separating direction.

Transmission gear 42 is coaxially overlapped on output gear 32. While driving gear 43 rotates clockwise, raised section 425 of transmission gear 42 moves in a separating direction from working surface 325 of output gear 32. Therefore, the rotation of transmission gear 42 is not transmitted to output gear 32, output gear 32 stops at the reference position, and toothless section 326 and driving gear 43 are kept in the facing state. Output shaft 323 therefore remains at rest, and hence ice tray 12 does not turn and is on standby at the horizontal position.

Even when output gear 32 is near rotation in response to the rotation of transmission gear 42, second abutting raised section 327A of output gear 32 abuts on second abutting wall 22 of case 20 as shown in FIG. 16A. Thus, output gear 32 is not driven by the rotation of transmission gear 42, and ice tray 12 is kept in the horizontal state.

Next, when ice tray 11 arrives at a first ice separation position, driving device 13 determines completion of the ice separation and stops the rotation of motor 49. Then, for returning ice tray 11 to the horizontal position, motor 49 rotates driving gear 43 counterclockwise.

Figure 18A:
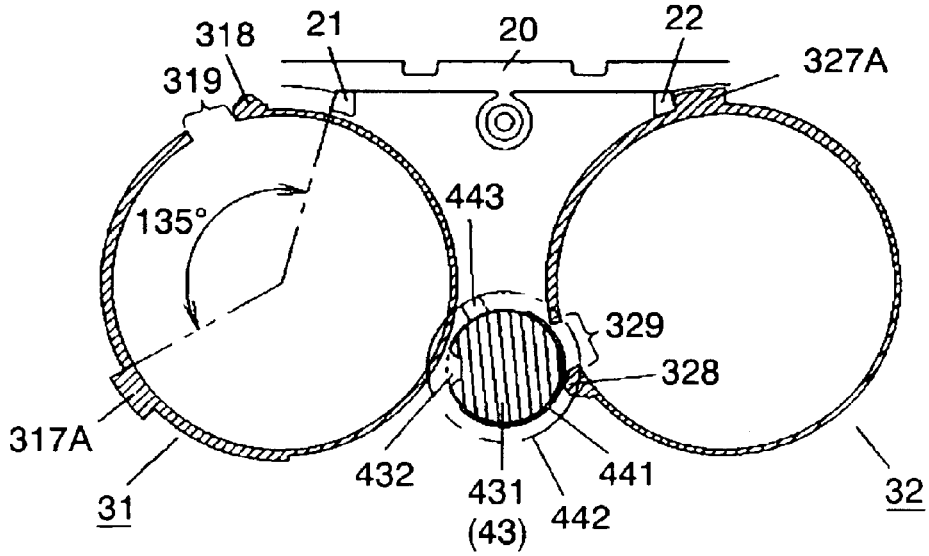
FIG. 18A is a plan view of a state where the first raised tooth returns from a first ice separation position to 135° position just before a reference position in accordance with the exemplary embodiment.

When driving gear 43 is rotated counterclockwise, column section 431 and slide member 44 also rotate counterclockwise. At this time, contact piece 443 of slide member 44 separates from the abutting position on the outer periphery of wall 327 of output gear 32, and contacts with the abutting position on the outer periphery of wall 317 of output gear 31 as shown in FIG. 18A. While driving gear 43 rotates counterclockwise, contact piece 443 slide-contacts with wall 317 of output gear 31. Slide member 44 stops also at this position with the outer periphery of semicylinder 441 faced to raised tooth 328.

While output gear 31 and transmission gear 41 rotate toward the reference positions, transmission gear 42 also rotates toward the reference position. While, output gear 32 remains at rest at the reference position. At this time, raised tooth 328 is abutting on the outer periphery of semicylinder 441, and semicylinder 441 blocks recessed tooth 432. Therefore, even when output gear 32 is near rotation in response to the rotation of transmission gear 42, output gear 32 does not mesh with driving gear 43.

Figure 18B:
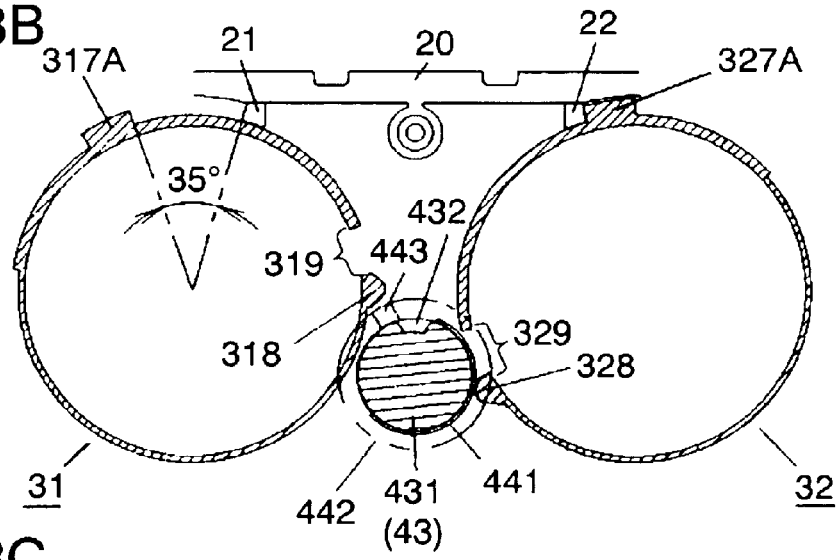
FIG. 18B is a plan view of a state where the first raised tooth returns from the first ice separation position to 35° position just before the reference position in accordance with the exemplary embodiment.
Figure 18C:
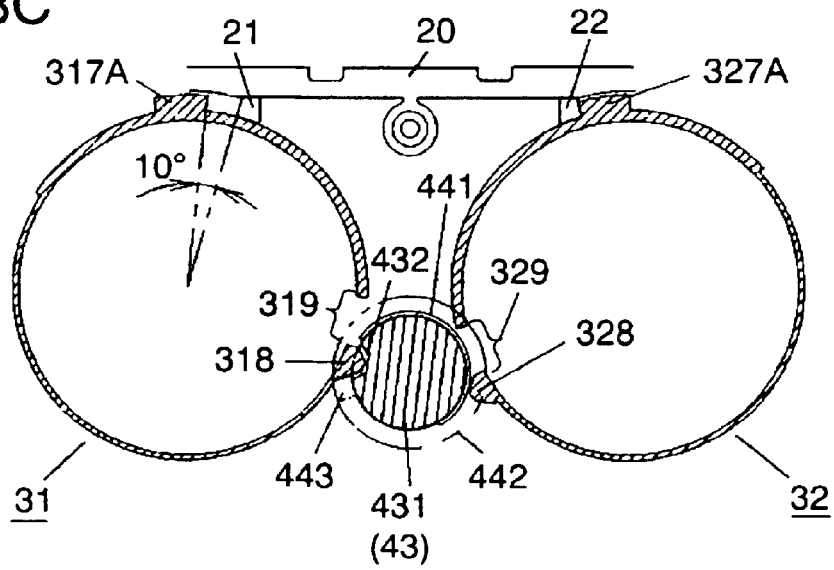
FIG. 18C is a plan view of a state where the first raised tooth returns from the first ice separation position to 10° position just before the reference position in accordance with the exemplary embodiment.

When ice tray 11 returns to the proximity of the horizontal position and output gear 31 returns to the proximity of the reference position, notch 319 faces contact piece 443 of slide member 44 as shown in FIG. 18B. Contact piece 443 travels toward wall 327 of output gear 32 through notch 319 as shown in FIG. 18C.

When output gear 31 arrives at the reference position, driving device 13 determines the return of ice tray 11 to the horizontal position and stops motor 49. At this time, contact piece 443 stops between wall 317 and wall 327.

An operation of separating ice from ice tray 12 is described with reference to FIG. 3, FIG. 6B, FIGS. 17A to 17C, and FIGS. 19A to 19C.

When driving device 13 separates ice from ice tray 12, driving device 13 rotates motor 49 to rotate driving gear 43 counterclockwise.

When driving gear 43 is rotated counterclockwise, transmission gear 42 meshing with driving gear 43 starts to rotate clockwise. Raised section 425 of transmission gear 42 abuts on working surface 325 of output gear 32, and transmission gear 42 and output gear 32 start to rotate together. At the reference position shown in FIG. 17A, recessed tooth 432 of column section 431 is not blocked, so that recessed tooth 432 meshes with raised tooth 328 of output gear 32. Thus, meshing of driving gear 43 with output gear 32 is established, and output gear 32 starts to rotate in the ice separating direction, as shown in FIG. 17B. Contact piece 443 of slide member 44 then travels through notch 329, and abuts on the outer periphery of wall 317 to stop, as shown in FIG. 17C.

When slide member 44 stops, semicylinder 441 directs its outer periphery toward raised tooth 318 of output gear 31. In other words, semicylinder 441 blocks recessed tooth 432 with respect to raised tooth 318, and opens recessed tooth 432 with respect to raised tooth 328.

While driving gear 43 rotates counterclockwise, output gear 32 turns ice tray 12 in the ice separating direction.

Transmission gear 41 is coaxially overlapped on output gear 31. While driving gear 43 rotates counterclockwise, raised section 415 of transmission gear 41 moves in a separating direction from working surface 315 of output gear 31. Therefore, the rotation of transmission gear 41 is not transmitted to output gear 31, output gear 31 stops at the reference position, and toothless section 316 and driving gear 43 are kept in the facing state. Output shaft 313 therefore remains at rest, and hence ice tray 11 does not turn and is on standby at the horizontal position.

Even when output gear 31 is near rotation in response to the rotation of transmission gear 41, first abutting raised section 317A of output gear 31 abuts on first abutting wall 21 of case 20 as shown in FIG. 17A. Thus, output gear 31 is not driven by the rotation of transmission gear 41, and ice tray 11 is kept in the horizontal state.

Next, when ice tray 12 arrives at a second ice separation position, driving device 13 determines completion of the ice separation and stops the rotation of motor 49. Then, for returning ice tray 12 to the horizontal position, motor 49 rotates driving gear 43 clockwise.

Figure 19A:
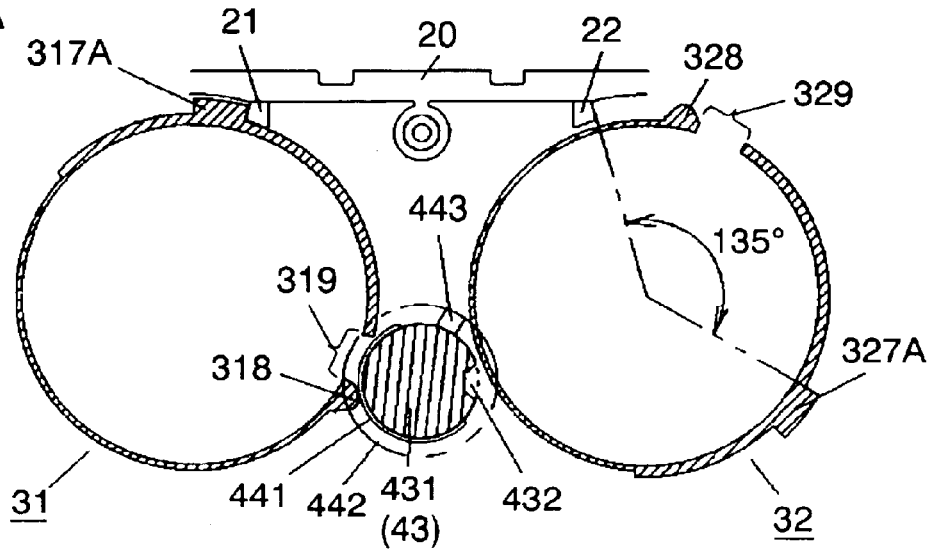
FIG. 19A is a plan view of a state where the second raised tooth returns from a second ice separation position to 135° position just before a reference position in accordance with the exemplary embodiment.

When driving gear 43 is rotated clockwise, column section 431 and slide member 44 also rotate clockwise. At this time, contact piece 443 of slide member 44 separates from the abutting position on the outer periphery of wall 317 of output gear 31 and contacts with the abutting position on the outer periphery of wall 327 of output gear 32 as shown in FIG. 19A. While driving gear 43 rotates clockwise, contact piece 443 slide-contacts with wall 327 of output gear 32. Slide member 44 stops also at this position with the cylindrical surface of semicylinder 441 faced to raised tooth 318.

While output gear 32 and transmission gear 42 rotate toward the reference positions, transmission gear 41 also rotate toward the reference position. While, output gear 31 remains at rest at the reference position. At this time, raised tooth 318 is abutting on the outer periphery of semicylinder 441, and semicylinder 441 blocks recessed tooth 432. Therefore, even when output gear 31 is near rotation in response to the rotation of transmission gear 41, output gear 31 does not mesh with driving gear 43.

Figure 19B:
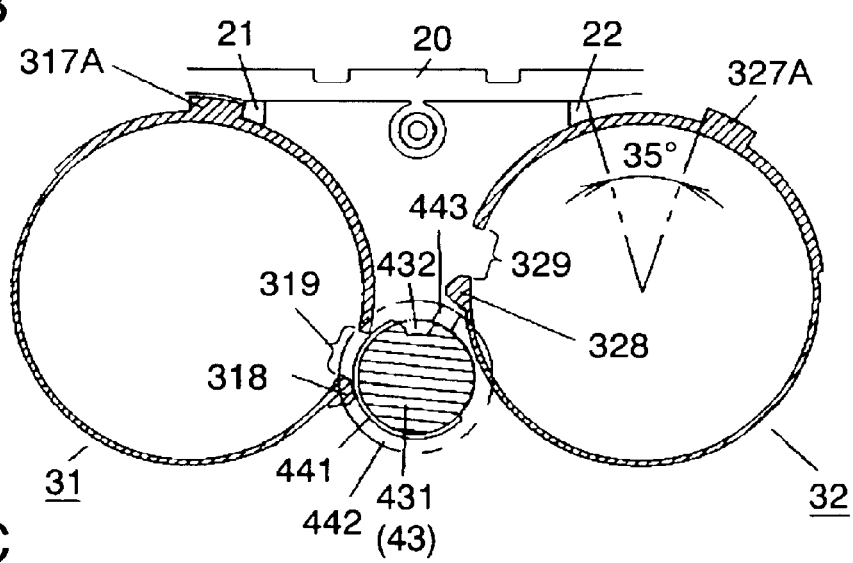
FIG. 19B is a plan view of a state where the second raised tooth returns from the second ice separation position to 35° position just before the reference position in accordance with the exemplary embodiment.
Figure 19C:
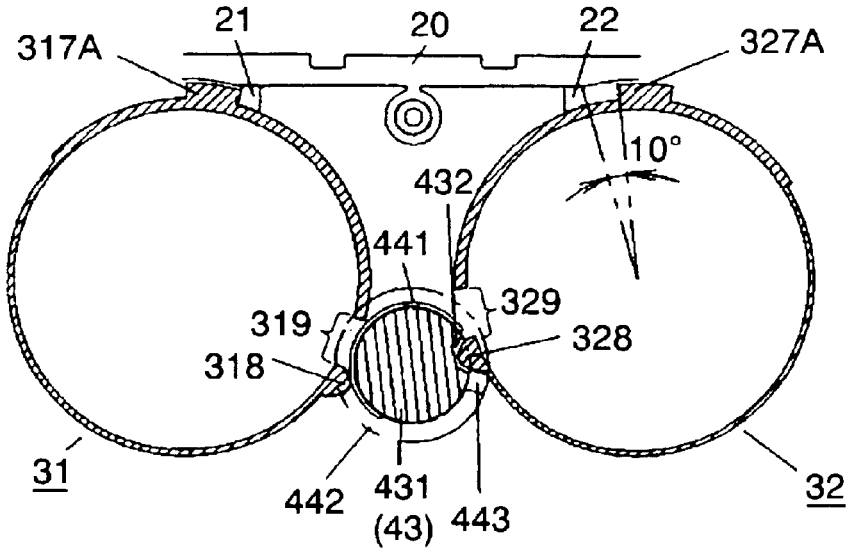
FIG. 19C is a plan view of a state where the second raised tooth returns from the second ice separation position to 10° position just before the reference position in accordance with the exemplary embodiment.
Figure 20:
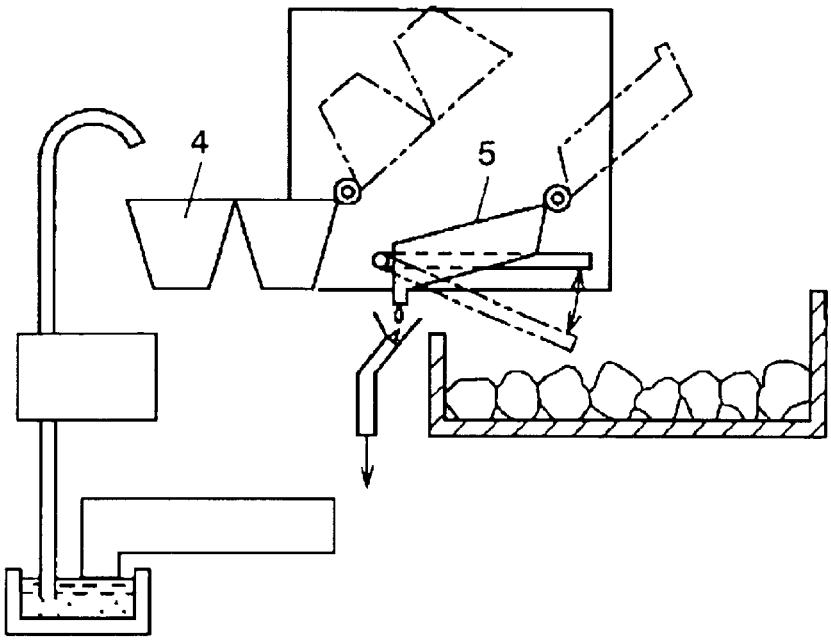
FIG. 20 PRIOR ART
FIG. 20 is a side view of a conventional automatic ice-making machine.
Figure 21:
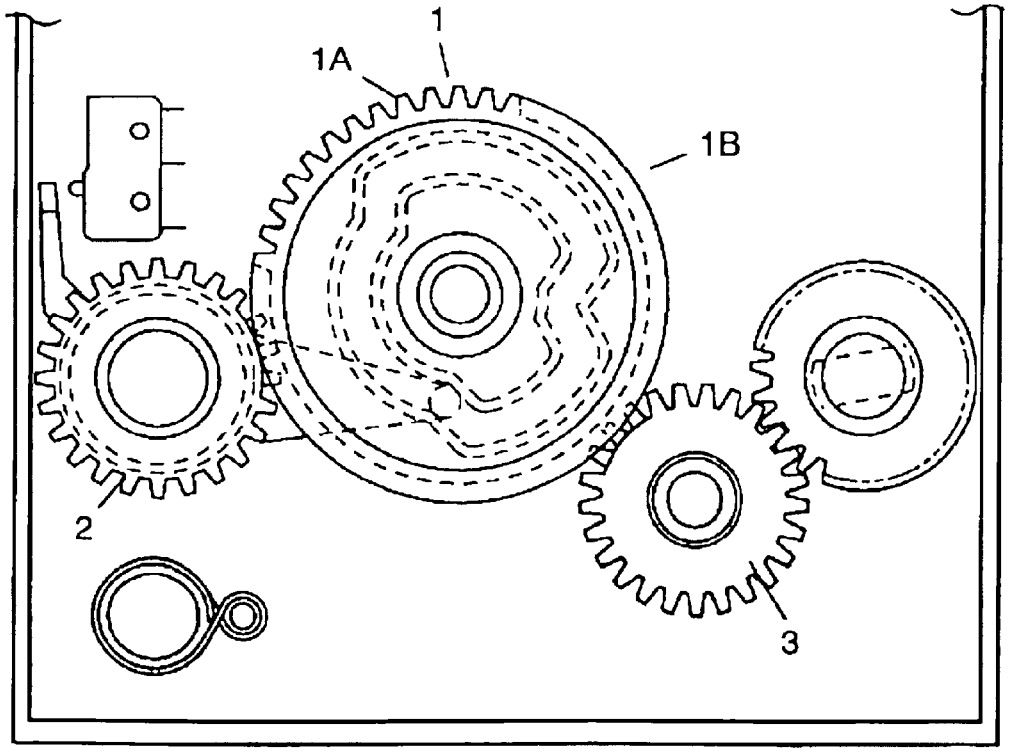
FIG. 21 PRIOR ART
FIG. 21 is a plan view of a driving device of the conventional automatic ice-making machine.

When ice tray 12 returns to the proximity of the horizontal position and output gear 32 returns to the proximity of the reference position, notch 329 faces contact piece 443 of slide member 44 as shown in FIG. 19B. Contact piece 443 travels toward wall 317 of output gear 31 through notch 329 as shown in FIG. 19C.

When output gear 32 arrives at the reference position, driving device 13 determines the return of ice tray 12 to the horizontal position and stops motor 49. At this time, contact piece 443 stops between wall 317 and wall 327.

The detection of a position of each ice tray is described with reference to FIG. 6 to FIG. 8C and FIG. 10A to FIG. 10C.

The position of ice tray 11 is detected based on detecting a rotation position of output gear 31. FIG. 8A to FIG. 8C are front views showing an operation of switch lever 71 and outer cam 81 formed on the lower surface of output gear 31 of driving device 13. FIG. 8A to FIG. 8C show a state where ice tray 11 lies at the horizontal position, a state where ice tray 11 lies at 45° counterclockwise, and a state where ice tray 11 lies at the first ice separation position, respectively.

When ice tray 11 arrives at the ice separation position, as shown in FIG. 8C, lever 71 lying under output gear 31 is operated by raised tooth 81C of outer cam 81 formed on the lower surface of output gear 31. Switch 51 generates an OFF signal and inputs it to controller 18.

On receiving the OFF signal from switch 51, controller 18 changes the rotation direction of motor 49 and turns ice tray 11 to return to the horizontal position. When ice tray 11 returns to the horizontal position, lever 71 is operated by raised tooth 81A as shown in FIG. 8A. Switch 51 then generates an OFF signal again. On receiving the OFF signal, controller 18 stops motor 49 to stop ice tray 11 at the horizontal position.

Similarly, the position of ice tray 12 is detected based on detecting a rotation position of output gear 32. FIG. 10A to FIG. 10C are front views showing an operation of switch lever 72 and outer cam 82 formed on the lower surface of output gear 32. FIG. 10A to FIG. 10C show a state where ice tray 12 lies at the horizontal position, a state where ice tray 12 lies at 45° clockwise, and a state where ice tray 12 lies at the second ice separation position, respectively.

When ice tray 12 arrives at the second ice separation position, as shown in FIG. 10C, lever 72 lying under output gear 32 is operated by raised tooth 82C of outer cam 82 formed on the lower surface of output gear 32. Switch 52 generates an OFF signal and inputs it to controller 18.

On receiving the OFF signal from switch 52, controller 18 changes the rotation direction of motor 49 and turns ice tray 12 to return to the horizontal position. When ice tray 12 returns to the horizontal position, lever 72 is operated by raised tooth 82A as shown in FIG. 10A. Switch 52 then generates an OFF signal again. On receiving the OFF signal, controller 18 stops motor 49' to stop ice tray 12 at the horizontal position.

An operation of detecting an amount of ice in ice box 14 is described with reference to FIG. 2, FIG. 3, FIG. 6A to FIG. 7, FIG. 9, and FIG. 11 to FIG. 14C.

Figure 11:
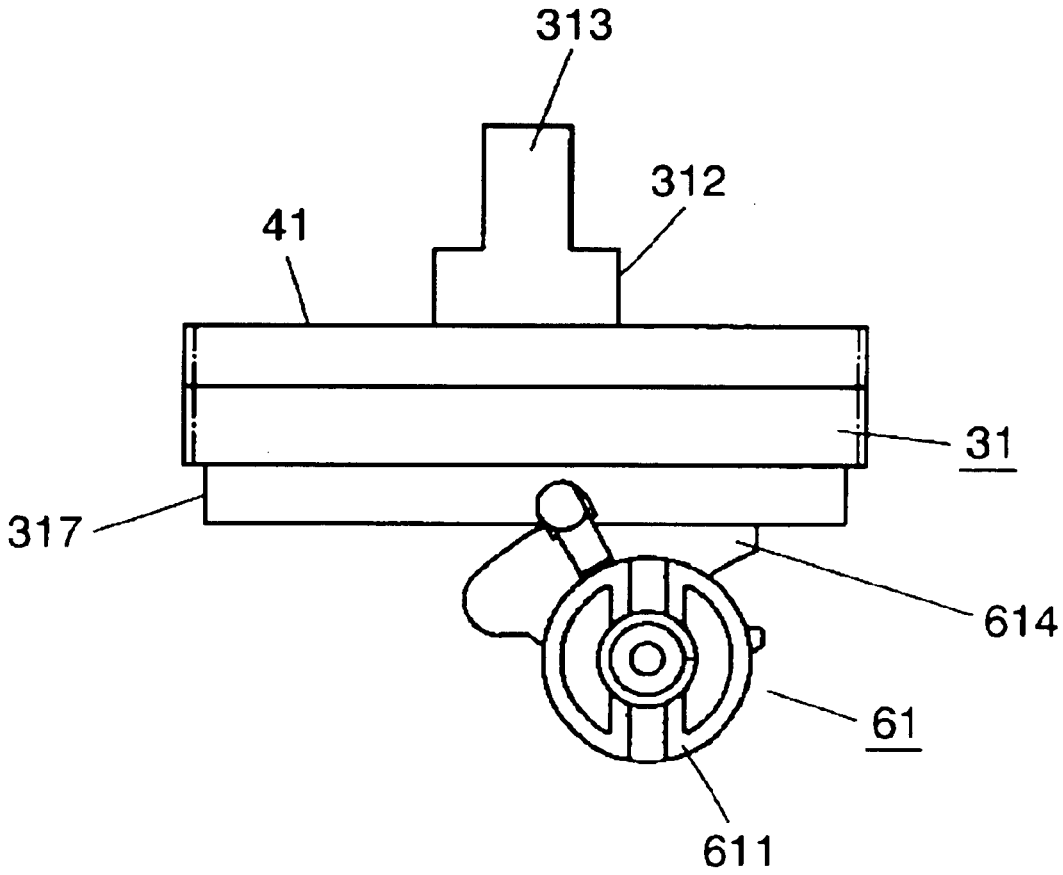
FIG. 11 is a front view showing a positional relation between the first output gear and a first ice detecting shaft in accordance with the exemplary embodiment.

The amount of ice stored in ice box 14 is detected based on whether or not levers 151 and 152 go into ice box 14 by more than a predetermined depth. FIG. 11 is a front view showing a positional relation between output gear 31 and first ice detecting shaft (hereinafter, shaft) 61. FIG. 12A to FIG. 12C are front views showing an operation of shaft 61 and first inner cam (hereinafter, inner cam) 91 formed on the lower surface of output gear 31. FIG. 12A to FIG. 12C show a state where ice tray 11 lies at the horizontal position, a state where ice tray 11 lies at 45° counterclockwise, and a state where ice tray 11 lies at the first ice separation position, respectively.

Figure 13:
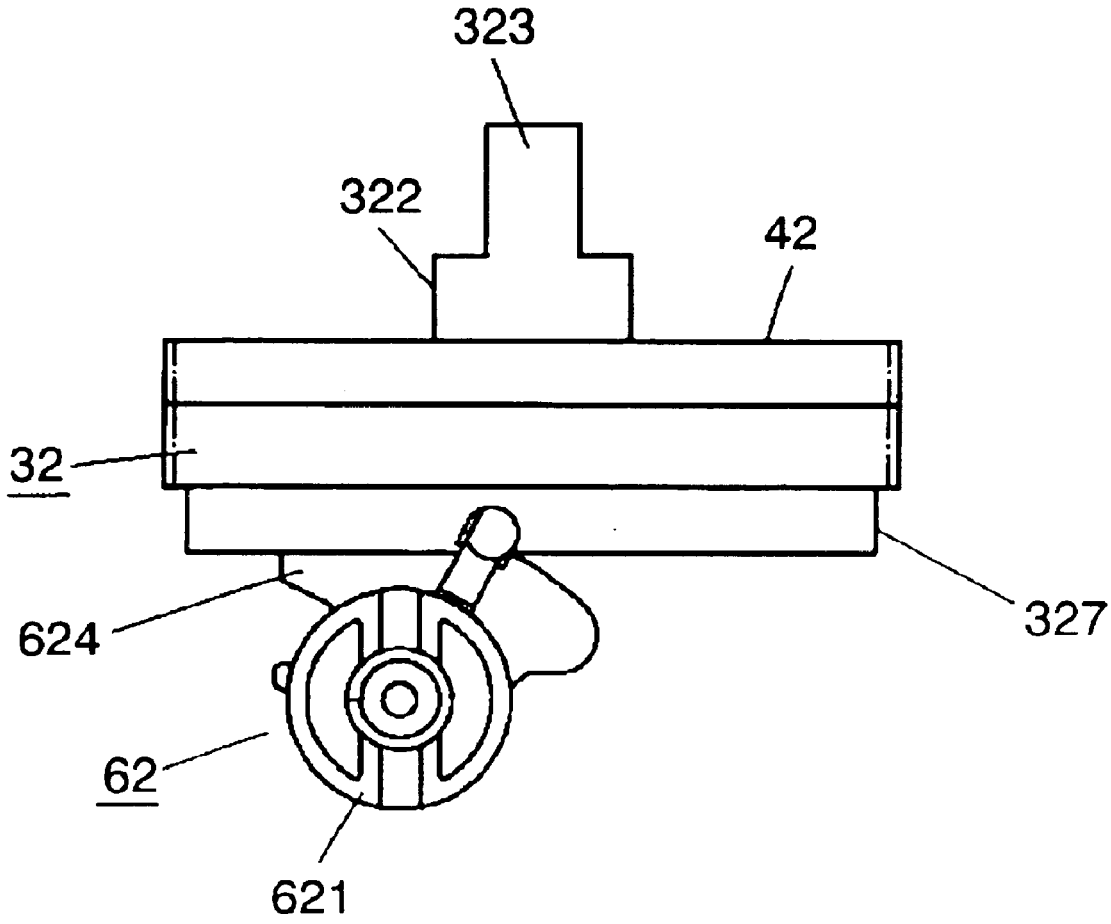
FIG. 13 is a front view showing a positional relation between the second output gear and a second ice detecting shaft in accordance with the exemplary embodiment.

FIG. 13 is a front view showing a positional relation between output gear 32 and second ice detecting shaft (hereinafter, shaft) 62. FIG. 14A to FIG. 14C are front views showing an operation of shaft 62 and second inner cam (hereinafter, inner cam) 92 formed on the lower surface of output gear 32. FIG. 14A to FIG. 14C show a state where ice tray 12 lies at the horizontal position, a state where ice tray 12 lies at 45° clockwise, and a state where ice tray 12 lies at the second ice separation position, respectively.

A case of detecting an amount of ice stored in partition 141 of ice box 14 is described. When output gear 31 rotates to separate from the horizontal position, shaft 61 is released from constraint of raised section 91A of inner cam 91. Shaft 61 is turned by tension of first spring 631 and faces recessed section 91B. This situation is shown in FIG. 12A and FIG. 12B. Lever 151 connected to shaft 61 also turns, so that lever 151 goes into partition 141 of ice box 14 as shown in FIG. 2.

At this time, projection (block section) 614 of shaft 61 faces projection 714 of lever 71 as shown in FIG. 7, so that lever 151 goes into partition 141 by more than the predetermined depth if ice is lacking in partition 141. The turning angle of shaft 61 exceeds a predetermined value, so that projection 614 of shaft 61 presses projection 714 of lever 71 to operate switch 51, thereby generating an OFF signal.

On receiving the OFF signal, controller 18 detects that the ice is lacking in partition 141. When the ice is lacking in partition 141, ice tray 11 turns to the first ice separation position. At this time, raised section 91C returns inner shaft 612 of shaft 61 as shown in FIG. 12C, and lever 151 moves above partition 141 of ice box 14.

When the ice amount in partition 141 is sufficient, lever 151 does not go into partition 141 by more than the predetermined depth, and the turning angle of shaft 61 does not exceed the predetermined value. Therefore, projection 614 cannot press projection 714 of lever 71 and hence no OFF signal is generated from switch 51. Controller 18 determines that the ice amount is sufficient.

A case of detecting an amount of ice stored in partition 142 of ice box 14 is then described. When output gear 32 rotates to separate from the horizontal position, inner shaft 622 of shaft 62 is released from constraint of raised section 92A of inner cam 92. Shaft 62 is turned by tension of second spring 632 and faces recessed section 92B (FIG. 14A and FIG. 14B). Lever 152 connected to shaft 62 also turns, so that lever 152 goes into partition 142 of ice box 14.

At this time, projection (block section) 624 of shaft 62 faces projection 724 of lever 72 as shown in FIG. 9, so that lever 152 goes into partition 142 by more than the predetermined depth if ice is lacking in partition 142. The turning angle of shaft 62 exceeds a predetermined value, so that projection 624 of shaft 62 presses projection 724 of lever 72 to operate switch 52, thereby generating an OFF signal.

On receiving the OFF signal, controller 18 detects that the ice is lacking in partition 142. When the ice is lacking in partition 142, ice tray 12 turns to the second ice separation position. At this time, raised section 92C returns inner shaft 622 of shaft 62 as shown in FIG. 14C, and lever 152 moves above partition 14B of ice box 14.

When the ice amount in partition 142 is sufficient, lever 152 does not go into partition 142 by more than the predetermined depth, and the turning angle of shaft 62 does not exceed the predetermined value. Therefore, projection 624 cannot press projection 724 of lever 72 and hence no OFF signal is generated from switch 52. Controller 18 determines that the ice amount is sufficient. Controller 18 determines positions of ice trays 11 and 12 and excess or deficiency of the ice amount in ice box 14 based on a combination of the rotation direction of motor 49 and ON and OFF of switches 51 and 52. Disposing a timer (not shown) allows certain classification of the information.

The ice tray driving device of the automatic ice-making machine of the present embodiment has output gears 31 and 32 for turning respective ice trays 11 and 12, and driving gear 43 for driving output gears 31 and 32. The number of teeth of driving gear 43 is smaller than those of output gears 31 and 32, and driving gear 43 is disposed in a region formed between output gears 31 and 32. Transmission gears 41 and 42 are disposed in respective transmission passages between output gear 31 and driving gear 43 and between output gear 32 and driving gear 43, respectively. Transmission gears 41 and 42 have a section where they individually rotate in cooperation with driving gear 43 and a section where they rotate together coaxially with output gears 31 and 32, respectively.

When driving gear 43 drives transmission gear 41, transmission gear 41 and output gear 31 coaxially rotate together to turn ice tray 11. At this time, transmission gear 42 rotates, but does not transmit the rotation to output gear 32. Ice tray 12 is therefore at rest at the horizontal position.

When transmission gear 42 and output gear 32 coaxially rotate together, ice tray 12 turns. At this time, transmission gear 41 rotates, but does not transmit the rotation to output gear 31. Ice tray 11 is therefore at rest at the horizontal position.

In other words, driving gear 43 has teeth of which number is smaller than those of output gears 31 and 32, and is disposed in a small region formed between output gears 31 and 32. When the structure is designed so that rotation is transmitted to transmission gear 41 coaxial with output gear 31 and rotation is transmitted to transmission gear 42 coaxial with output gear 32, the vertical size of driving device 13 can be reduced and hence the occupied space in refrigerator can be suppressed.

Output gears 31 and 32 have respective cylindrical walls 317 and 327 axially adjacent to respective gear sections. Raised tooth 318 formed by projecting one of teeth of output gear 31 in the tooth width direction is disposed on wall 317, and raised tooth 328 formed by projecting one of teeth of output gear 32 in the tooth width direction is disposed on wall 327. Output gear 31 has notch 319 circumferentially adjacent to raised tooth 318 in wall 317, and output gear 32 has notch 329 circumferentially adjacent to raised tooth 328 in wall 327. The ice tray driving device of the automatic ice-making machine of the present embodiment also has slide member 44. Slide member 44 has contact piece 443 that abuts on and slide-contacts with one of walls 317 and 327. When driving gear 43 rotates output gear 31, contact piece 443 of slide member 44 travels to wall 327 through notch 319 to stop. Semicylinder 441 then blocks recessed tooth 432 of column section 431 to prevent mesh of raised tooth 328 of output gear 32 with recessed tooth 432. When driving gear 43 rotates output gear 32, contact piece 443 travels to wall 317 through notch 329 to stop. Semicylinder 441 then blocks recessed tooth 432 to prevent mesh of raised tooth 318 of output gear 31 with recessed tooth 432. When driving gear 43 lies at the reference position, contact piece 443 of slide member 44 lies at a position where contact piece 443 does not contact with either of walls 317 and 327. When raised tooth 318 of output gear 31 meshes with recessed tooth 432 of driving gear 43 to rotate output gear 31 toward the first ice separation position, contact piece 443 of slide member 44 travels through notch 319 and abuts on wall 327 to stop. When raised tooth 328 of output gear 32 meshes with recessed tooth 432 of driving gear 43 to rotate output gear 32 toward the second ice separation position, contact piece 443 of slide member 44 travels through notch 319 and abuts on wall 317 to stop. In either case, slide member 44 having semicylinder 441 blocks recessed tooth 432 of column section 431 with respect to either of raised teeth of output gears 31 and 32 to disable meshing with recessed tooth 432. When driving gear 43 rotates output gear 31 from the first ice separation position toward the reference position, contact piece 443 of slide member 44 moves from the abutting position on wall 327 to the abutting position on wall 317 and stands by. Slide member 44 releases the blocking of recessed tooth 432 of column section 431 only with respect to raised tooth 318 of output gears 31 to allow the mesh. Then, contact piece 443, on facing to notch 319, passes through notch 319 and returns to the reference position. While, when driving gear 43 rotates output gear 32 from the second ice separation position toward the reference position, contact piece 443 of slide member 44 moves from the abutting position on wall 317 to the abutting position on wall 327 and stands by. Slide member 44 releases the blocking of recessed tooth 432 of column section 431 only with respect to raised tooth 328 of output gear 32 to allow the mesh. Then, contact piece 443, on facing to notch 329, passes through notch 329 and returns to the reference position. Thus, slide member 44 has a simple structure where it is held by driving gear 43, only one of ice trays 11 and 12 can be driven, driving device 13 can be downsized, and its assembling property is improved. Ice trays 11 and 12 are turned between the ice separation position and the horizontal position without transmission gear 41 or 42. Therefore, when driving gear 43 starts to invert, ice trays 11 and 12 instantly start to turn.

In the ice tray driving device of the automatic ice-making machine of the present embodiment, case 20 has abutting walls 21 and 22, and output gears 31 and 32 have abutting raised sections 317A and 327A, respectively. Abutting wall 21 and abutting raised section 317A form the first abutting section, and abutting wall 22 and abutting raised section 327A form the second abutting section. At the reference position, the first abutting section prevents output gear 31 from rotating during the rotation of output gear 32. At the reference position, the second abutting section prevents output gear 32 from rotating during the rotation of output gear 31. This structure certainly keeps the suspended ice tray at the horizontal position.

The ice tray driving device of the present embodiment has outer cams 81 and 82 on the lower surfaces of output gears 31 and 32, respectively. Shaft 61 coupled to lever 151 is driven by outer cam 81, and shaft 62 coupled to lever 152 is driven by outer cam 82. Controller 18 recognizes which one of ice trays 11 and 12 is short of ice. Controller 18 can preferentially make ice in the ice tray short of ice.

The ice tray driving device of the present embodiment has inner cams 91 and 92 on the lower surfaces of output gears 31 and 32, respectively. Inner cams 91 and 92 operate switch levers 71 and 72 disposed under output gears 31 and 32, respectively. This structure allows controller 18 to detect turning positions of ice trays 11 and 12 and to stop the turnings, and allows each ice tray to certainly stop at the ice separation position or horizontal position.

The present invention provides an ice tray driving device of an automatic ice-making machine that has a mesh start section for starting the mesh of one of two output gears with a driving gear. The mesh start section includes a raised tooth, a column section, a recessed tooth, and a slide member. The raised tooth is formed by projecting at least one tooth of the two output gears in the tooth width direction. The column section is axially adjacent to the driving gear. The recessed tooth is disposed in the column section and formed so as to mesh with the raised tooth. The slide member blocks the recessed tooth in the column section at a predetermined position. When the driving gear rotates, the slide member rotates together with the column section by a predetermined angle and then slide-contacts with the column section. When the driving gear rotates one of the two output gears, the slide member keeps the blockage of the recessed tooth with respect to the raised tooth of the output gear that is not rotated, and prevents meshing of the recessed tooth with the raised tooth of the output gear that is not rotated. Thus, the raised tooth can be meshed with the recessed tooth only by facing of them regardless of size of the driving gear, two output gears can be individually driven, and the ice tray driving device can be downsized.

What is claim is:

1. An ice tray driving device of an automatic ice-making machine comprising:

first and second output gears for turning first and second ice trays to perform an ice separating operation, respectively:

a driving gear for rotating the first and second output gears; and a mesh start section for starting meshing of the first output gear with the driving gear when the driving gear rotates from a reference position in one direction, and for starting meshing of the second output gear with the driving gear when the driving gear rotates from the reference position in the other direction, each of positions of the first and second output gears and the driving gear provided when the first and second ice trays lie in horizontal states being set as each reference position, wherein the mesh start section includes a first raised tooth formed by projecting at least one tooth of the first output gear in the tooth width direction, a second raised tooth formed by projecting at least one tooth of the second output gear in the tooth width direction, a column section axially adjacent to the driving gear, a recessed tooth disposed in the column section and formed so as to mesh with the first and second raised teeth, and a slide member that blocks the recessed tooth in the column section at a predetermined position, and, when the driving gear rotates, rotates together with the column section by a predetermined angle and then slide-contacts with the column section, wherein the slide member keeps blockage of the recessed tooth with respect to the second raised tooth when the driving gear rotates the first output gear, and keeps blockage of the recessed tooth with respect to the first raised tooth when the driving gear rotates the second output gear.

2. An ice tray driving device according to claim 1, wherein the slide member prevents mesh of the second raised tooth with the recessed tooth when the driving gear rotates the first output gear, and prevents mesh of the first raised tooth with the recessed tooth when the driving gear rotates the second output gear.

3. An ice tray driving device according to claim 1, wherein the first raised tooth is disposed on a cylindrical first circumferential wall axially adjacent to the first output gear, the second raised tooth is disposed on a cylindrical second circumferential wall axially adjacent to the second output gear, the mesh start section further includes a first notch disposed in the first circumferential wall and circumferentially adjacent to the first raised tooth, a second notch disposed in the second circumferential wall and circumferentially adjacent to the second raised tooth, and a contact piece that is disposed on the slide member and abuts on and slide-contacts with one of the first and second circumferential walls, when the driving gear rotates the first output gear, the contact piece travels to the second circumferential wall through the first notch and stops, and when the driving gear rotates the second output gear, the contact piece travels to the first circumferential wall through the second notch and stops.

4. An ice tray driving device according to claim 1, further comprising:

a case for storing the first output gear, the second output gear, the driving gear, and the mesh start section, a first abutting section where the case abuts on the first output gear at the reference position, and a second abutting section where the case abuts on the second output gear at the reference position.

5. An ice tray driving device according to claim 4, wherein the first abutting section has a first abutting wall disposed in the case and a first abutting raised section disposed on the first output gear, and the second abutting section has a second abutting wall disposed in the case and a second abutting raised section disposed on the second output gear.

6. An ice tray driving device according to claim 1, further comprising:

a first abutting section for preventing the first output gear from rotating in cooperation with the second output gear when the second output gear rotates, and a second abutting section for preventing the second output gear from rotating in cooperation with the first output gear when the first output gear rotates.

7. An ice tray driving device according to claim 1, further comprising:

a first ice detector for detecting an amount of ice stored in a first ice storing section for storing ice separated from the first ice tray, and a second ice detector for detecting an amount of ice stored in a second ice storing section for storing ice separated from the second ice tray.

8. An ice tray driving device according to claim 7, wherein the first ice detector has a first cam interlocking with the first output gear, and a first ice detecting shaft that turns in cooperation with the first cam and is coupled to a first ice detecting lever, the first ice detecting lever moving vertically in response to the amount of ice stored in the first ice storing section, and the second ice detector has a second cam interlocking with the second output gear, and a second ice detecting shaft that turns in cooperation with the second cam and is coupled to a second ice detecting lever, the second ice detecting lever moving vertically in response to the amount of ice stored in the second ice storing section.

9. An ice tray driving device according to claim 1, further comprising first and second ice-tray-position detectors for detecting horizontal positions and ice separation positions of the first and second ice trays, respectively.

10. An ice tray driving device according to claim 9, wherein the first ice-tray-position detector comprises a first cam interlocking with the first output gear, a first switch lever having a projection driven by the first cam and a first contact point, and a first switch for generating a signal on contacting with the first contact point, and the second ice-tray-position detector comprises a second cam interlocking with the second output gear, a second switch lever having a projection driven by the second cam and a second contact point, and a second switch for generating a signal on contacting with the second contact point.

11. An ice tray driving device according to claim 10, further comprising:

a first ice detector having the first cam, and a first ice detecting shaft that turns in cooperation with the first cam and is coupled to a first ice detecting lever, the first ice detecting lever moving vertically in response to an amount of ice stored in a first ice storing section for storing ice separated from the first ice tray, and for detecting the amount of the ice stored in the first ice storing section, and a second ice detector having the second cam, and a second ice detecting shaft that turns in cooperation with the second cam and is coupled to a second ice detecting lever, the second ice detecting lever moving vertically in response to an amount of ice stored in a second ice storing section for storing ice separated from the second ice tray, and for detecting the amount of the ice stored in the second ice storing section, wherein the first ice detecting shaft blocks an operation of the first switch lever when the ice in the first ice storing section is less than a predetermined amount, and the second ice detecting shaft blocks an operation of the second switch lever when the ice in the second ice storing section is less than a predetermined amount.

12. An ice tray driving device according to claim 1, wherein the number of teeth of the driving gear is smaller than one of those of the first and second output gears.

13. An ice tray driving device according to claim 1, wherein the rotating axis of the driving gear, the rotating axis of the first output gear, and the rotating axis of the second output gear are disposed so as to form a triangle.

14. An ice tray driving device according to claim 1, further comprising:

a first transmission gear that is coaxial with the first output gear and has a section that individually rotates in cooperation with the driving gear and a section that rotates together with the first output gear, and a second transmission gear that is coaxial with the second output gear and has a section that individually rotates in cooperation with the driving gear and a section that rotates together with the second output gear.

15. An automatic ice-making machine comprising:

first and second ice trays;

an ice tray driving device, and a cooler for cooling contents stored in at least the first and second ice trays, the ice tray driving device including:

first and second output gears for turning the first and second ice trays to perform an ice separating operation, respectively;

a driving gear for rotating the first and second output gears; and a mesh start section for starting meshing of the first output gear with the driving gear when the driving gear rotates from a reference position in one direction, and for starting meshing of the second output gear with the driving gear when the driving gear rotates from the reference position in the other direction, each of positions of the first and second output gears and the driving gear provided when the first and second ice trays lie in horizontal states being set as each reference position, wherein the mesh start section includes a first raised tooth formed by projecting at least one tooth of the first output gear in the tooth width direction, a second raised tooth formed by projecting at least one tooth of the second output gear in the tooth width direction, a column section axially adjacent to the driving gear, a recessed tooth disposed in the column section and formed so as to mesh with the first and second raised teeth, and a slide member that blocks the recessed tooth in the column section at a predetermined position, and, when the driving gear rotates, rotates together with the column section by a predetermined angle and then slide-contacts with the column section, wherein the slide member keeps the blockage of the recessed tooth with respect to the second raised tooth when the driving gear rotates the first output gear, and keeps the blockage of the recessed tooth with respect to the first raised tooth when the driving gear rotates the second output gear.

* * * * *